US011359896B2

(12) United States Patent
Morse et al.

(10) Patent No.: US 11,359,896 B2
(45) **Date of Patent: *Jun. 14, 2022**

(54) FRANGIBLE FIREARM PROJECTILES, METHODS FOR FORMING THE SAME, AND FIREARM CARTRIDGES CONTAINING THE SAME

(71) Applicant: Federal Cartridge Company, Anoka, MN (US)

(72) Inventors: Joseph Franklin Morse, Albany, OR (US); Ralph Nauman, Bend, OR (US); Robert Charles Nichols, Albany, OR (US)

(73) Assignee: Federal Cartridge Company, Anoka, MN (US)

( * ) Notice: Subject to any disclaimer, the term of this patent is extended or adjusted under 35 U.S.C. 154(b) by 149 days.

This patent is subject to a terminal disclaimer.

(21) Appl. No.: 16/381,977

(22) Filed: Apr. 11, 2019

(65) Prior Publication Data

US 2019/0242681 A1 Aug. 8, 2019

Related U.S. Application Data

(62) Division of application No. 15/461,848, filed on Mar. 17, 2017, now Pat. No. 10,260,850.

(Continued)

(51) Int. Cl.
*B22F 5/00* (2006.01)
*F42B 12/74* (2006.01)

(Continued)

(52) U.S. Cl.
CPC ..... *F42B 12/367* (2013.01); *B22F 5/003* (2013.01); *F42B 5/02* (2013.01); *F42B 7/04* (2013.01);

(Continued)

(58) Field of Classification Search
CPC ..... F42B 12/367; F42B 12/74
See application file for complete search history.

(56) References Cited

U.S. PATENT DOCUMENTS 701,298 A 6/1902 Cowper-Coles
1,514,908 A 11/1924 Jannell (Continued)

FOREIGN PATENT DOCUMENTS

CA 521944 2/1956
GB 731237 6/1955

(Continued)

OTHER PUBLICATIONS

"Steel 3-inch Magnum Loads Our Pick For Waterfowl Hunting," *Gun Tests*, Jan. 1998, pp. 25-27.

(Continued)

*Primary Examiner* — Gabriel J. Klein
(74) *Attorney, Agent, or Firm* — Reed Smith LLP; Matthew P. Frederick; John M. Cogdill

(57) ABSTRACT

Frangible firearm projectiles, firearm cartridges, and methods for forming the same. The projectiles are formed from metal powder and include an anti-sparking agent. One or more of iron, zinc, bismuth, tin, copper, nickel, tungsten, boron, and/or alloys thereof may form the metal powder. The projectiles may be formed from a compacted mixture of two or more different metal powders. The anti-sparking agent may include a borate, such as boric acid, zinc chloride, and/or petrolatum. The anti-sparking agent may be dispersed within, and/or applied as a coating on, the exterior of the projectile. The compacted mixture may be heat treated for a time sufficient to form a plurality of discrete alloy domains within the compacted mixture. Such domains may be formed by a mechanism that includes vapor-phase diffusion bonding and oxidation of the metal powders and that does (Continued)

form a liquid phase of the metal powder or utilize a polymeric binder.

21 Claims, 6 Drawing Sheets

Related U.S. Application Data

(60) Provisional application No. 62/407,879, filed on Oct. 13, 2016, provisional application No. 62/310,489, filed on Mar. 18, 2016.

(51) Int. Cl.

| | |
|---|---|
| ***F42B 5/02*** | (2006.01) |
| ***C22C 1/04*** | (2006.01) |
| ***C22C 33/02*** | (2006.01) |
| ***F42B 12/36*** | (2006.01) |
| ***F42B 7/04*** | (2006.01) |
| ***F42B 7/10*** | (2006.01) |
| ***F42B 30/02*** | (2006.01) |
| ***F42B 7/08*** | (2006.01) |

(52) U.S. Cl.

CPC ..... *F42B 7/08* (2013.01); *F42B 7/10* (2013.01); *F42B 12/74* (2013.01); *F42B 30/02* (2013.01); *B22F 2998/10* (2013.01); *B22F 2999/00* (2013.01); *C22C 1/0483* (2013.01); *C22C 33/0278* (2013.01)

(56) References Cited

U.S. PATENT DOCUMENTS 1,847,617 A 3/1932 Lowenstein et al.
2,119,876 A 6/1938 Corson
2,168,381 A * 8/1939 Woodford ..... F42B 12/74 102/529
2,178,529 A * 10/1939 Calkins ..... B22F 3/18 419/43
2,183,359 A 12/1939 Smithells
2,226,002 A * 12/1940 Langhammer ..... B21K 1/025 86/54
2,346,124 A * 4/1944 Dew ..... C10M 7/00 508/583
2,360,473 A * 10/1944 Calkins ..... F42B 14/04 102/511
2,775,536 A 12/1956 Fine
2,919,471 A 1/1960 Hechinger
2,995,090 A 8/1961 Daubenspeck
3,123,003 A 3/1964 Lange, Jr. et al.
3,372,021 A 3/1968 Forbes et al.
3,623,849 A 11/1971 Benjamin
3,669,656 A 6/1972 Murphy et al.
3,785,801 A 1/1974 Benjamin
3,888,636 A 6/1975 Sczerzenie et al.
3,890,145 A 6/1975 Vert et al.
3,953,194 A 4/1976 Hartline, III et al.
3,979,234 A 9/1976 Northcutt, Jr. et al.
4,027,594 A 6/1977 Olin et al.
4,035,115 A 7/1977 Hansen
4,035,116 A 7/1977 O'Brien et al.
4,138,249 A 2/1979 Rosof
4,274,940 A 6/1981 Plancqueel et al.
4,338,126 A 7/1982 Vanderpool et al.
4,383,853 A 5/1983 Zapffe
4,428,295 A 1/1984 Urs
4,488,959 A 12/1984 Agar
4,735,146 A * 4/1988 Wallace ..... C10M 117/02 102/511
4,760,794 A 8/1988 Allen
4,762,559 A 8/1988 Penrice et al.
4,780,981 A 11/1988 Hayward et al.
4,784,690 A 11/1988 Mullendore
4,836,108 A 6/1989 Kegel et al.
4,881,465 A 11/1989 Hooper et al.
4,897,117 A 1/1990 Penrice
4,921,250 A 5/1990 Ayres
4,931,252 A 6/1990 Brunisholz et al.
4,940,404 A 7/1990 Ammon et al.
4,949,644 A 8/1990 Brown
4,949,645 A 8/1990 Hayward et al.
4,960,563 A 10/1990 Nicolas
4,961,383 A 10/1990 Fishman et al.
4,990,195 A 2/1991 Spencer et al.
5,069,869 A 12/1991 Nicolas et al.
5,088,415 A 2/1992 Huffman et al.
5,160,805 A 11/1992 Winter
5,264,022 A 11/1993 Haygarth et al.
5,279,787 A 1/1994 Oltrogge
5,399,187 A 3/1995 Mravic et al.
5,527,376 A 6/1996 Amick et al.
5,679,920 A 10/1997 Hallis et al.
5,713,981 A 2/1998 Amick
5,719,352 A 2/1998 Griffin
5,740,516 A 4/1998 Jiranek, II et al.
5,760,331 A 6/1998 Lowden et al.
5,786,416 A 7/1998 Gardner et al.
5,814,759 A 9/1998 Mravic et al.
5,820,707 A 10/1998 Amick et al.
5,831,188 A 11/1998 Amick et al.
5,847,313 A 12/1998 Beal
5,868,879 A 2/1999 Amick et al.
5,877,437 A 3/1999 Oltrogge
5,894,644 A 4/1999 Mravic
5,905,936 A 5/1999 Fenwick et al.
5,913,256 A 6/1999 Lowden et al.
5,917,143 A 6/1999 Stone
5,922,978 A 7/1999 Carroll
5,950,064 A 9/1999 Robinson et al.
5,963,776 A 10/1999 Lowden et al.
6,048,379 A 4/2000 Bray et al.
6,074,454 A 6/2000 Abrams et al.
6,090,178 A 7/2000 Benini
6,136,105 A 10/2000 Spencer
6,174,494 B1 1/2001 Lowden et al.
6,182,574 B1 2/2001 Giannoni
6,248,150 B1 6/2001 Amick
6,257,149 B1 7/2001 Cesaroni
6,263,798 B1 7/2001 Benini
6,270,549 B1 8/2001 Amick
6,279,447 B1 8/2001 Beal
6,371,029 B1 4/2002 Beal
6,439,124 B1 8/2002 Enlow et al.
6,447,715 B1 9/2002 Amick
6,457,417 B1 10/2002 Beal
6,527,824 B2 3/2003 Amick
6,527,880 B2 3/2003 Amick
6,530,328 B2 3/2003 Burczynski et al.
6,536,352 B1 3/2003 Nadkami et al.
6,546,875 B2 4/2003 Vaughn et al.
6,551,375 B2 4/2003 Siddle et al.
6,551,376 B1 4/2003 Beal
6,581,523 B2 6/2003 Beal
6,591,730 B2 7/2003 Beal
6,805,057 B2 10/2004 Carr et al.
6,845,719 B1 1/2005 Spencer
7,059,233 B2 6/2006 Amick
7,607,394 B2 10/2009 Cesaroni
7,966,937 B1 * 6/2011 Jackson ..... F42B 12/74 102/517
9,188,416 B1 11/2015 Hash et al.
9,222,050 B1 * 12/2015 Simonetti ..... F41A 29/02
9,528,804 B2 12/2016 Amick
2002/0124759 A1 9/2002 Amick
2002/0152915 A1 10/2002 Vaughn et al.
2003/0027005 A1 2/2003 Elliott
2003/0101891 A1 6/2003 Amick
2003/0161751 A1 8/2003 Elliott
2003/0164063 A1 9/2003 Elliott
2010/0043662 A1 2/2010 Arvidsson et al.
2010/0242778 A1 9/2010 Calero Martinez et al.

(56) References Cited

U.S. PATENT DOCUMENTS

| | | | | |
|---|---|---|---|---|
| 2011/0293955 | A1* | 12/2011 | Trowbridge | C23C 26/00 428/457 |
| 2012/0308426 | A1* | 12/2012 | Perez | F42B 8/14 419/66 |
| 2017/0205215 | A1 | 7/2017 | Sloff et al. | |
| 2020/0094319 | A1* | 3/2020 | Nichols | F42B 12/74 |

FOREIGN PATENT DOCUMENTS

| | | |
|---|---|---|
| GB | 1175274 | 12/1969 |
| GB | 1514908 | 6/1978 |
| GB | 2149067 | 6/1985 |
| JP | 52-68800 | 6/1977 |
| JP | 59-6305 | 1/1984 |
| JP | 1-142002 | 6/1989 |
| WO | WO 00/37878 | 6/2000 |

OTHER PUBLICATIONS

Carmichel, Jim, "Heavy Metal Showdown," *Outdoor Life*, Apr. 1997, pp. 73-78.

"Federal's New Tungsten Pellets," *American Hunter*, Jan. 1997, pp. 19, 48-50.

Li, C.-J., et al., "Enhanced Sintering of Tungsten-Phase Equilibria Effects on Properties," The International Journal of Powder Metallurgy & Powder Technology, vol. 20, No. 2, pp. 149-162 (Apr. 1984).

Sykes, W. P., "The Iron-tungsten System," Meeting of the American Institute of Mining and Metallurgical Engineers, New York, pp. 968-1008 (Feb. 1926).

English-language abstract of Japanese Patent Publication No. 59-6305, 1984.

English-language abstract of Japanese Patent Publication No. 1-142002, 1989.

* cited by examiner

FRANGIBLE FIREARM PROJECTILES, METHODS FOR FORMING THE SAME, AND FIREARM CARTRIDGES CONTAINING THE SAME

RELATED APPLICATIONS

This application is a divisional patent application that claims priority to U.S. patent application Ser. No. 15/461,848, which was filed on Mar. 17, 2017 and issued as U.S. Pat. No. 10,260,850 on Apr. 16, 2019, which claims priority under 35 U.S.C. § 119(e) to U.S. Provisional Patent Application No. 62/310,489, which was filed on Mar. 18, 2016, and to U.S. Provisional Patent Application No. 62/407,879, which was filed on Oct. 13, 2016. The disclosures of these patent applications are hereby incorporated by reference.

FIELD

The present disclosure relates generally to the field of firearm ammunition, and more particularly to the field of frangible firearm ammunition.

BACKGROUND

Firearm projectiles are designed to have a variety of properties when they impact a target or other object after being fired from a firearm. Some firearm projectiles are designed to be penetrators that are very strong and are intended to pierce the impacted object while at least substantially retaining the projectile's shape. Some firearm projectiles are designed to be ductile so that the projectile deforms, typically by expanding in width, when it impacts and/or penetrates the impacted object. Other firearm projectiles are designed to break into very small particles when the projectiles impact a hard object. These latter firearm projectiles may be referred to as frangible firearm projectiles.

Frangible firearm projectiles often are used in practice ranges and other situations where ricocheting projectiles, or larger fragments thereof, are undesirable. An example of an existing frangible firearm bullet is a Sinterfire™ bullet, such as is disclosed in U.S. Pat. Nos. 6,090,178 and 6,263,798, the disclosures of which are hereby incorporated by reference. Sinterfire™ is a trademark of Sinterfire, Inc. of Kersey, Pa. USA. Sinterfire™ firearm projectiles have proven to be effective frangible firearm projectiles, but the copper and tin powders used to form the projectiles are comparatively more expensive than many other powders that are used in firearm projectiles. Thus, there is a need for an effective frangible firearm projectile alternative to Sinterfire™ projectiles.

SUMMARY

Frangible firearm projectiles, firearm cartridges containing the same, and methods for forming the same are disclosed herein. The firearm projectiles are formed from metal powder and include an anti-sparking agent. One or more of iron, zinc, bismuth, tin, copper, nickel, tungsten, boron, and/or alloys thereof may form the metal powder, and the firearm projectiles may be formed from a compacted mixture of powder of two or more different metals. The anti-sparking agent may include a borate, such as boric acid, zinc chloride, and/or petrolatum. The anti-sparking agent may be dispersed within the frangible firearm projectile and/or applied as a coating on the exterior of the frangible firearm projectile. The compacted mixture may be heat treated for a time sufficient to form a plurality of discrete alloy domains within the compacted mixture. The heat treating may be regulated to create chemical bonds within the compacted mixture via at least vapor-phase diffusion bonding and oxidation of the metal powders. The heat treating may not include forming a liquid phase of any of the metal powders or utilizing a polymeric binder. The heat treating may include heating the compacted mixture to a threshold set point temperature at a regulated rate and maintaining the compacted mixture at or near the threshold set point temperature for a time sufficient to form the frangible firearm projectile. The heat treating also may include regulating the cooling of the frangible firearm projectile after the heating and maintaining.

DETAILED DESCRIPTION

Figure 1:
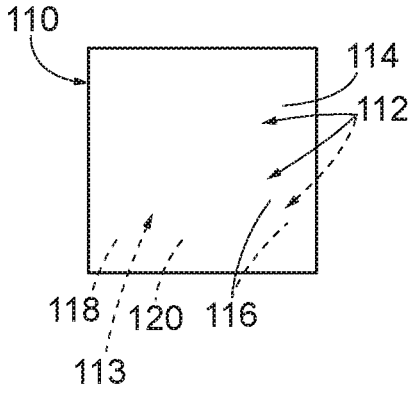
FIG. 1 is a schematic representation of a compacted mixture of metal powders according to the present disclosure.

FIGS. 1-11 provide examples of firearm projectiles 100 according to the present disclosure, of firearm cartridges 10 that include projectiles 100, of compacted mixtures 110 of metal powders 112 from which projectiles 100 are formed, and/or of methods 200 for forming firearm projectiles 100 and/or firearm cartridges 10. Elements that serve a similar, or at least substantially similar, purpose are labeled with like numbers in each of FIGS. 1-11, and these elements may not be discussed in detail herein with reference to each of FIGS. 1-11. Similarly, all elements may not be labeled in each of FIGS. 1-11, but reference numbers associated therewith may be utilized herein for consistency. Elements, components, and/or features that are discussed herein with reference to one or more of FIGS. 1-11 may be included in and/or utilized with the subject matter of any of FIGS. 1-11 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a given embodiment without departing from the scope of the present disclosure.

Firearm projectiles 100 according to the present disclosure are frangible firearm projectiles 100. As discussed in more detail herein, frangible firearm projectiles may be formed from a compacted mixture of metal powders without requiring polymeric binders or the formation of liquid metal phases of the metal powders of the compacted mixture of metal powders. Instead, the projectiles are formed via a powder metallurgy process in which compacted mixtures of metal powders are heated for a time, at a heating rate, and at a temperature sufficient to form a sufficient plurality of discrete (i.e., spaced apart) alloy domains within the compacted mixture of metal powders. The plurality of discrete alloy domains adds sufficient strength to the compacted mixture of metal powders for the compacted mixture of metal powders to have sufficient strength and integrity to remain intact during the remainder of any processing to form a frangible firearm projectile, and for the resulting frangible firearm projectile to remain intact during assembly (which may utilize automated loading/assembly machinery) into a firearm cartridge, packaging and shipment of the firearm cartridge, and loading of the firearm cartridge into a firearm. When the metal powders include iron and zinc powders, the plurality of discrete alloy domains may be described as being formed from vapor-phase galvanizing of the iron powder by the zinc powder.

The heat-treating process further strengthens the resulting frangible firearm projectile by forming other chemical bonds therein, such as by oxidation of the metal powders. This oxidation bonding may include oxide bonding between adjacent iron powder particles and/or mixed metal oxide bonding between the iron and zinc powders.

By "frangible," it is meant that a firearm projectile 100 according to the present disclosure will break into small particulate when fired at a metal surface (such as a steel plate) at close range (such as 15 feet (4.57 meters)) from a firearm cartridge. The particulate may have a maximum particle size and/or maximum particle weight. As examples, the maximum particle weight may be at most 25 grains, at most 20 grains, at most 15 grains, at most 10 grains, at most 7.5 grains, at most 5 grains, in the range of 1-10 grains, in the range of 3-15 grains, in the range of 2-8 grains, and/or in the range of 0.5-5 grains. As used herein, "in the range of" means any value that is at one of the recited end points or anywhere between the end points. As additional or alternative examples, the maximum particle weight may be 1%, 3%, 5%, or 7.5% of the weight of the firearm projectile. The weight of the firearm projectile additionally or alternatively may be referred to as the pre-firing, or nominal, weight of the firearm projectile.

FIG. 1 schematically illustrates a compacted mixture 110 of metal (or metallic) powders 112 according to the present disclosure, from which frangible firearm projectile 100 is formed. As used herein, the term "powder" is meant to include particulate having the same or a variety of shapes and sizes, including generally spherical or irregular shapes, flakes, needle-like particles, chips, fibers, equiaxed particles, etc. The individual metal powders 112 may vary in coarseness and/or mesh-size. In some embodiments, metal powders 112 may be selected to have a particular range of particle sizes, a maximum particle size, and/or a minimum particle size. For example, one or more of the compositions of metal powders 112 may have a greater or lesser percentage of fine powder ("fines") (e.g., −325 mesh) than another and/or all of the other compositions of metal powders. As another example, one or more of the compositions of metal powders 112 may have a greater or lesser percentage of coarse powder (e.g., +100 mesh) than another and/or all of the other compositions of metal powders. Compacted mixture 110 additionally or alternatively may be referred to as a compact 110, a green compact 110, and/or a green projectile 110.

Each metal powder 112 and/or each composition of metal powder 112 may have any appropriate particle size. As examples, each metal powder of the plurality of unique compositions of metal powders has a mesh size that is at least 20 mesh, at least 40 mesh, at least 60 mesh, at least 80 mesh, at least 100 mesh, at least 120 mesh, at most 80 mesh, at most 100 mesh, at most 120 mesh, at most 140 mesh, at most 160 mesh, at most 180 mesh, and/or at most 200 mesh.

As "mixture" suggests, the compacted mixture 110 includes metal powders 112 of two or more metals, or metal compositions, that are mixed together prior to the mixture being compacted. Compacted mixture 110 will include two or more different compositions of metal powders 112 that collectively form at least 94% of the compacted mixture, and optionally at least 95%, at least 96%, at least 97%, at least 98%, at least 98.5%, at least 99%, at least 99.5%, or 100% of the compacted mixture. Unless otherwise explicitly indicated herein, all percentages are percentages by weight, or weight percentages. Thus, the compacted mixture of metal powders comprises at least 94 wt % metal powders 112, but is not required in all embodiments to be formed entirely of metal powders 112. Compacted mixture 110 of metal powders 112 additionally or alternatively may be referred to as a compacted mixture 110 that includes metal powders 112 and/or a compacted mixture 110 containing at least 94 wt % metal powders 112. Similar terminology may be utilized to refer to the mixture prior to being compacted.

In embodiments in which the compacted mixture 110 of metal powders 112 is not entirely formed from metal powders 112, the remaining minority portion, or percentage, of the compacted mixture 110 of metal powders 112 may be formed from one or more non-metallic components 113. Examples of non-metallic components 113 that may be, but are not required in all embodiments to be, included in compacted mixture 110 and/or firearm projectiles 100 formed therefrom include a lubricant 120 and an anti-sparking agent 118. Lubricant 1120 and/or anti-sparking agent 118, when present may form at most 5 wt %, at most 4 wt %, at most 3 wt %, at most 2 wt %, at most 1 wt %, in the range of 0.5-5 wt %, in the range of 1-3 wt %, and/or in the range of 1.5-4 wt % of the compacted mixture 110 of metal powders 112.

Illustrative examples of metal powders 112 that may be present in compacted mixture 110 include powdered (i.e., powders of) iron, zinc, copper, tungsten, bismuth, nickel, tin, boron, and alloys thereof. Compacted mixture 110 (and thus frangible firearm projectile 100) may be formed of only non-toxic materials and/or may not include lead. In such embodiments, the compacted mixture 110, the resulting frangible firearm projectile 100, and a firearm cartridge 10 that includes the frangible firearm projectile may be referred to as being non-toxic and/or lead-free. Compacted mixture 110 (and thus frangible firearm projectile 100) may include powders of metals and metal compositions (i.e., metal alloys) other than the examples mentioned above. In some projectiles 100, compacted mixture 110 includes powders of only two different metals. In some such projectiles 100, one of the metals is iron and the other is selected from the group consisting of zinc, copper, tungsten, bismuth, nickel, tin, boron, and alloys thereof. In some projectiles 100, compacted mixture 110 includes powders of three different metals. In some such projectiles 100, one of the metals is iron and one or both of the other two metals are selected from the group consisting of zinc, copper, tungsten, bismuth, nickel, tin, boron, and alloys thereof.

Compacted mixture 110 may include equal or unequal amounts of each of the compositions of metal powders present therein. Compacted mixture 110 may include a metal powder that forms a primary, or majority, component 114 of the compacted mixture 110 by being present in the compacted mixture more than any of the other compositions of metal powders. In such a compacted mixture 110, the compacted mixture also may be described as including one or more metal powders that each form a secondary component 116 that is present to a lesser extent than the majority component.

Compacted mixture 110 (and thus frangible firearm projectile 100 formed therefrom) may include at least 35% iron. In some embodiments, the majority component 114 of compacted mixture 110 is iron. In some embodiments, compacted mixture 110 and frangible firearm projectile 100 may include 40-90%, 51-90%, 60-90%, 70-90%, 50-80%, 60-80%, 70-85%, at least 50%, at least 60%, at least 70%, at least 80%, at least 90%, at least 95%, at most 95%, at most 90%, and/or at most 85% iron. Compacted mixture 110 (and thus projectile 100) may include 0-40%, 0-30%, 0-20%, 0-15%, 0-10%, 0-5%, 5-40%, 5-35%, 5-30%, 5-25%, 5-20%, 5-15%, 5-10%, 10-30%, 10-25%, 10-20%, 10-15%, 0%, at least 5%, and/or at least 10% of each of zinc, copper, tungsten, bismuth, nickel, tin, boron, and/or alloys thereof. By this, it is meant that powders of one or more of these metals may be present in compacted mixture 110 and frangible firearm projectile 100, but none of these metals are required to be present in all compacted mixtures 110 and/or frangible firearm projectiles 100 according to the present disclosure. An example of a suitable iron powder is Anchorsteel™ 1000, optionally with the fines removed, but others may be used. In some embodiments, the compacted mixture 110 may include a different metal as the majority component. For example, the compacted mixture may include tungsten (such as at least 40 wt %, at least 50 wt %, and/or at least 60 wt % tungsten powder) or copper (such as at least 40 wt %, at least 50 wt %, and/or at least 60 wt % copper powder) as majority component 114.

When compacted mixture 110 includes a majority component 114 of a particular metal powder, the mixture additionally or alternatively may be described as being substantially formed from the metal. For example, when iron powder is the majority component 114 of compacted mixture 110 and/or frangible firearm projectile 100, mixture 110 and projectile 100 may be described as being an iron-based mixture and an iron-based projectile.

As schematically illustrated in FIG. 1, compacted mixture 110 may include a non-metallic component 113 in the form of an anti-sparking agent 118. Anti-sparking agent 118 also may be referred to as an anti-sparking composition 118, an anti-sparking additive 118, a flame retardant 118, a flame-retarding agent 118, a flame-retarding composition 118, and/or a flame-retarding additive 118. As used herein, the term "agent" is intended to generally refer to any composition of matter, which may be a powder when introduced to the mixture of powders but is not required to be a powder. When present, anti-sparking agent 118 may reduce a propensity for frangible firearm projectile 100 to produce sparks upon striking a target after being fired. For example, when a frangible firearm projectile 100 that lacks an anti-sparking agent 118 is fired at a hard surface, such as a steel plate, the resulting impact may produce sparks, which in turn may introduce a fire hazard in the shooting environment. By contrast, a frangible firearm projectile 100 formed of a compacted mixture 110 that includes an anti-sparking agent 118 may not produce sparks upon striking a hard surface.

As an example, anti-sparking agent 118 may include boron and/or be a borate, such as boric acid and/or borax. As additional examples, anti-sparking agent 118 may be and/or include a fireproofing agent, such as zinc chloride and/or sodium bicarbonate. Additional examples of anti-sparking agent 118 include one or more of petrolatum, polybenzimidazole fiber, melamine, modacrylic fiber, and hydroquinone. When anti-sparking agent 118 includes boric acid, the anti-sparking agent also may exhibit lubricating properties, such as to assist in the relative movement and/or collective flow of the powders when forming the compacted mixture of metal powders.

When present, anti-sparking agent 118 may form at least 0.1%, at least 0.5%, at least 0.75%, at least 1%, at least 1.25%, at least 1.5%, at least 1.75%, at least 2%, at most 3%, at most 2%, at most 1.75%, at most 1.5%, at most 1.25%, at most 1%, at most 0.75%, at most 0.5%, 0.1-0.5%, 0.3-1%, 0.5-2%, 1-2%, and/or 1.5-2.5% of compacted mixture 110 and/or of a frangible firearm projectile 100 produced therefrom.

As indicated in FIG. 1, compacted mixture 110 also may include a lubricant 120. When present, lubricant 120 may facilitate the relative movement and/or collective flow of the powders when forming the compacted mixture of metal powders. Examples of lubricants include a wax (such as Accrawax™ wax and/or Keenolube™ wax), molybdenum disulfide, and graphite. When present, lubricant 120 may form at most 3%, at most 2%, at most 1%, at most 0.5%, 0.1-0.5%, and/or 0.3-1% of compacted mixture 110, and thus of a projectile 100 produced therefrom. Additionally or alternatively, when present, lubricant 120 may include a wax that forms at most 3%, at most 2%, at most 1%, at most 0.5%, 0.1-0.5%, and/or 0.3-1% of compacted mixture 110, and thus of a projectile 100 produced therefrom. In an embodiment in which compacted mixture 110 includes an anti-sparking agent 118 with lubricant properties, such as boric acid, anti-sparking agent 118 additionally may be described as including and/or being lubricant 120, and/or the lubricant additionally may be described as including the anti-sparking agent. For example, lubricant 120 may include and/or be a borate.

It is within the scope of the present disclosure that compacted mixture 110 may not include components other than metal powders 112, optional anti-sparking agent 118 and/or optional lubricant 120. For example, compacted mixture 110 and/or a frangible firearm projectile 100 formed therefrom may not include a polymeric binder that melts, cures, or otherwise adheres to bind the plurality of metal powders together. As also discussed, frangible firearm projectile 100 formed therefrom may not include or be formed without producing a liquid phase of any of the metal powders 112.

Compacted mixture 110 may be formed in any suitable manner and/or by any suitable process, with examples being discussed herein. The compacted mixture 110 may be shaped to have the near-net (i.e., approximate) or even the actual shape of the resulting frangible firearm projectile 100. For example, the compacted mixture 110 may be formed in a die, such as a near-net-shape die, that is shaped to impart a desired shape and size to the compacted mixture. Thus, the schematic representation of compacted mixture 110 shown in FIG. 1 is intended to generally represent any suitable (actual or near-net) shape and size for a firearm projectile.

The pressure applied to compact the mixture of metal powders 112 to form compacted mixture 110 may vary, as discussed herein, but should be sufficient to provide a defined, non-transitory shape to the compacted mixture. As examples, a compaction pressure in the range of 20-150 ksi (kilopounds per square inch) may be applied to form compacted mixture 110. More specific examples include pressures of at least 20 ksi, at least 30 ksi, at least 40 ksi, at least 50 ksi, at least 60 ksi, at least 70 ksi, at least 80 ksi, at least 90 ksi, at least 100 ksi, at least 110 ksi, at least 120 ksi, at least 130 ksi, at least 140 ksi, at most 150 ksi, at most 140 ksi, at most 130 ksi, at most 120 ksi, at most 110 ksi, at most 110 ksi, at most 90 ksi, at most 80 ksi, at most 70 ksi, at most 60 ksi, at most 50 ksi, and/or pressures in the range of 20-50 ksi, 25-45 ksi, 40-100 ksi, 40-90 ksi, 60-90 ksi, 70-100 ksi, and/or 70-120 ksi.

Figure 2:
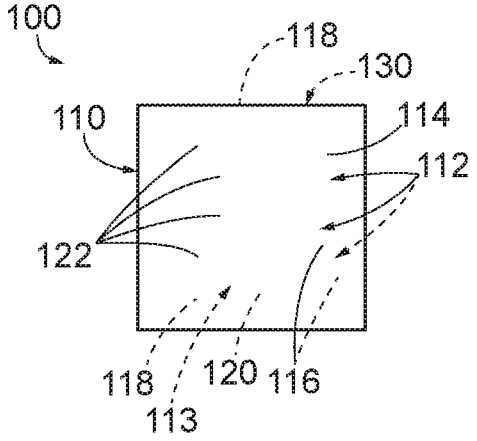
FIG. 2 is a schematic representation of a firearm projectile according to the present disclosure.

FIG. 2 schematically depicts a frangible firearm projectile 100 formed from the compacted mixture 110 of metal powders 112 of FIG. 1. Frangible firearm projectile 100 may be at least substantially, if not entirely, formed from compacted mixture 110. As examples, at least 90%, at least 93%, at least 95%, at least 97%, at least 98%, at least 99%, 90-96%, 93-97%, 95-98%, 96-99.5%, or 100% of frangible firearm projectile 100 may be formed from compacted mixture 110 of metal powders 112. In some embodiments, frangible firearm projectile 100 may be described as comprising one of the above-discussed percentages of compacted mixture 110. In some embodiments, frangible firearm projectile 100 may be described as consisting essentially of one of the above-described percentages of compacted mixture 110.

As shown in FIG. 2, a difference between FIG. 1 and FIG. 2 is that frangible firearm projectile 100 includes a plurality of discrete alloy domains 122. The alloy domains 122 additionally or alternatively may be referred to as intermetallic domains 122, intermetallic alloy domains 122, solid solution domains 122, and/or ordered intermetallic alloy domains 122. These discrete domains additionally or alternatively may be referred to as spaced-apart alloy regions, localized regions, and/or spaced-apart localized regions. Thus, unlike a firearm projectile formed from a molten metal alloy, or a process in which the projectile is formed from liquid-phase sintering of the metal powders, frangible firearm projectile 100 does not include a homogenous or continuous alloy of the metal powders.

As discussed, the plurality of discrete alloy domains 122 adds strength to the compacted mixture 110 (after formation of the discrete alloy domains) for the compacted mixture to remain intact during the remainder of any processing to form frangible firearm projectile 100, and for the resulting frangible firearm projectile to remain intact during assembly (which may utilize automated loading/assembly machinery) into a firearm cartridge, packaging and shipment of the firearm cartridge, loading of the firearm cartridge into a firearm, and pre-impact discharge from the firearm after the cartridge is fired. As examples, the plurality of discrete alloy domains may provide, enable, and/or contribute to frangible firearm projectile 100 being able to withstand an impact force and/or a crushing force of at least 50 pounds, at least 60 pounds, at least 70 pounds, at least 80 pounds, at least 90 pounds, at least 100 pounds, at least 150 pounds, at least 200 pounds, at least 250 pounds, at least 300 pounds, at least 350 pounds, at least 400 pounds, at least 450 pounds, at least 500 pounds, at least 550 pounds, at least 600 pounds, at most 650 pounds, at most 625 pounds, at most 575 pounds, at most 525 pounds, at most 475 pounds, at most 425 pounds, at most 375 pounds, at most 325 pounds, at most 275 pounds, at most 225 pounds, at most 175 pounds, and/or at most 125 pounds, and/or in the range of 50-100 pounds, 60-80 pounds, 70-100 pounds, 100-250 pounds, 100-350 pounds, 200-350 pounds, 200-450 pounds, 300-450 pounds, 300-550 pounds, 400-550 pounds, 400-650 pounds, and/or 500-650 pounds. However, the plurality of discrete alloy domains may not be sufficiently large and/or numerous to render the compacted mixture of metal powders or the resulting firearm cartridge infrangible (i.e., not frangible).

As used herein, the crushing force, or crushing force, may refer to a threshold force that may be applied across a diameter of frangible firearm projectile 100 before the frangible firearm projectile is crushed or otherwise yields or breaks into fragments. Thus, the crush force may be measured as the weight that is applied against the side of the frangible firearm projectile, such as via a press or other testing device, before the frangible firearm projectile loses its structural integrity or otherwise is crushed, broken, etc.

Figure 12:
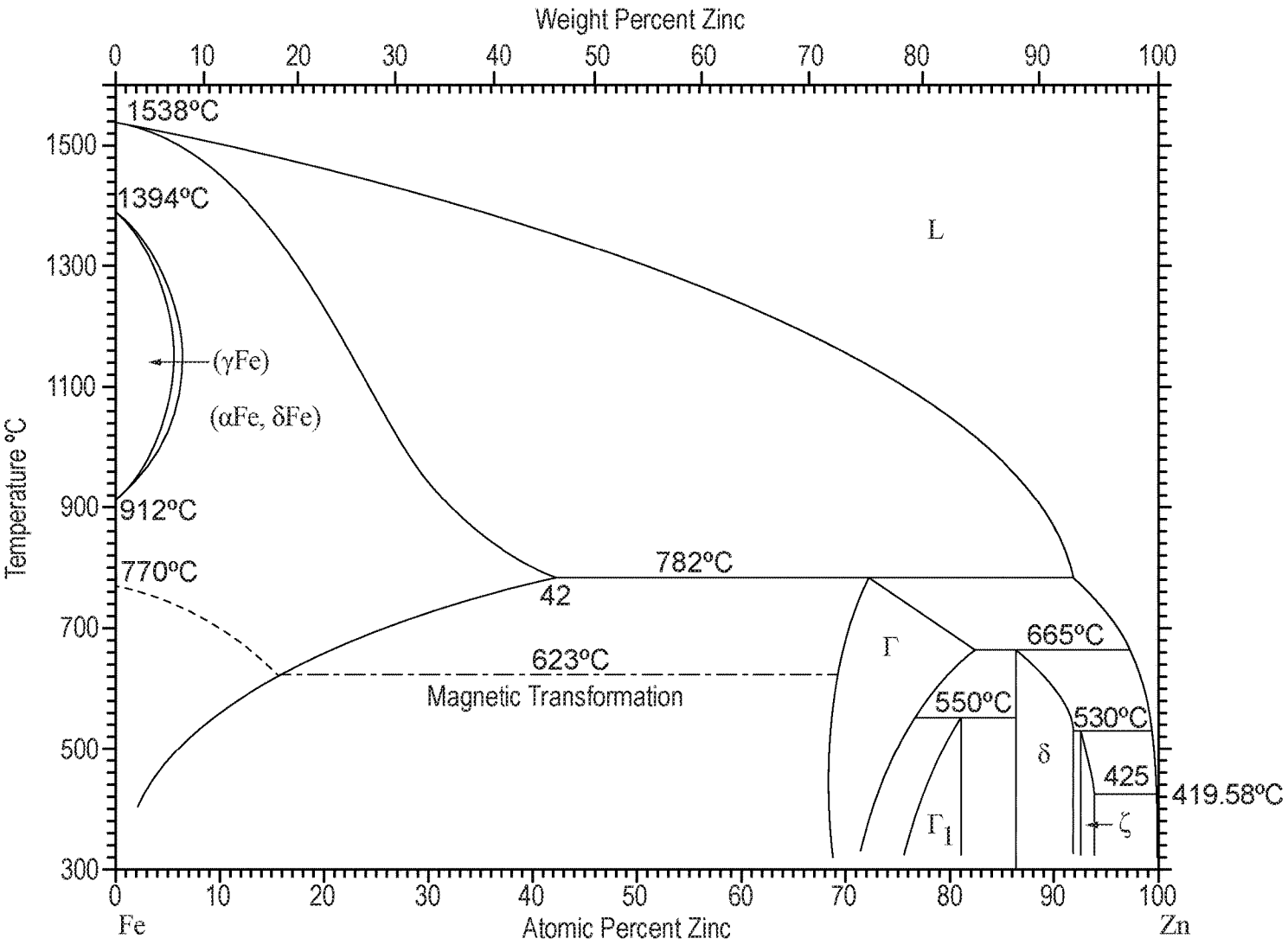
FIG. 12 is an iron-zinc phase diagram.

The plurality of discrete alloy domains 122 may be formed by heating compacted mixture 110 at a temperature, at a rate, and for a time sufficient to form the plurality of discrete alloy domains from the powders present in compacted mixture 110. When frangible firearm projectile 100 contains iron powder and zinc powder, the resulting discrete alloy domains 122 may represent alloys in one or more of the delta phase, the gama phase, and/or the zeta phase of the iron-zinc phase diagram, illustrated in FIG. 12.

The formation of the discrete alloy domains creates chemical bonds within the compacted mixture of metal powders. The discrete alloy domains may be formed by vapor-phase diffusion bonding of the zinc and iron powders, such as vapor-phase diffusion bonding of the zinc powder into the iron powder. An additional mechanism by which the compacted mixture obtains strength while remaining frangible is via chemical bonds formed by oxidation of metal powders (such as iron powder and zinc powder) in the compacted mixture during the heat treatment process. As discussed in more detail herein, the heat treating regulates the rate at which the various metal powders are oxidized so as to result in a frangible firearm projectile 100 having the properties described herein.

Additional mechanisms by which chemical bonds are formed within the compacted mixture include one or more of solid-phase diffusion bonding, vapor-phase galvanization (for mixtures of iron powder and zinc powder), solid-phase sintering, oxidation, covalent metal oxide bonding, and friction from compaction (Van der Waals forces between abutting powder particles). When the compacted mixture includes an anti-sparking agent that include a borate, such as boric acid, the boric acid may melt during the heat-treating process and migrate through metal powder particle boundaries by capillary action to form glassy phases with the metal oxides. This may further strengthen the frangible firearm projectile without impairing the frangibility thereof. It also may assist in regulating the oxidation of one or more of the types of metal powder and/or in reducing swelling of the compacted mixture during the heat-treating process.

Regardless of the mechanism(s) utilized by a particular method and/or with a particular combination of metal powders, the mechanism does not include forming a liquid-phase from the metal powders 112 or from a polymeric binder. Thus, the diffusion bonding additionally or alternatively may include and/or be referred to as solid-phase diffusion bonding and/or gas-phase diffusion bonding, but not liquid-phase diffusion bonding. Similarly, the sintering may include and/or be referred to as solid-phase sintering, as opposed to liquid-phase sintering.

Frangible firearm projectile 100 may have any suitable density for firearm projectiles. The density may be a result of the composition, particle size, and/or relative percentage of metal powders 112 in compacted mixture 110, the amount of anti-sparking agent 118 (if any) included in the compacted mixture, the amount of lubricant 120 (if any) included in the compacted mixture, the applied compaction pressure, and/or the heat treatment process utilized to form the frangible firearm projectile. For example, frangible firearm projectile 100 may have a density of at least 6 g/cc, at least 6.5 g/cc, at least 6.8 g/cc, at least 7 g/cc, at least 7.5 g/cc, at least 8 g/cc, at least 8.5 g/cc, at least 9.0 g/cc, at least 9.5 g/cc, at least 10.0 g/cc, at most 11 g/cc, at most 10 g/cc, at most 9.5 g/cc, at most 9 g/cc, at most 8.5 g/cc, at most 8.0 g/cc, at most 7.5 g/cc, at most 7.0 g/cc, in the range of 6.0-8.0 g/cc, in the range of 7.0-10.0 g/cc, in the range of 6.5-9.5 g/cc, in the range of 7.0-8.5 g/cc, in the range of 7.5-9.5 g/cc, in the range of 7.5-8.5 g/cc, in the range of 6.0-8.0 g/cc, in the range of 6.5-7.5 g/cc, and/or in the range of 6.8-7.2 g/cc. Additionally or alternatively, projectile 100 may be created to have a density that corresponds to (exactly or within +/−0.1 g/cc, within +/−0.2 g/cc, within +/−0.3 g/cc, within +/−0.4 g/cc, and/or within +/−0.5 g/cc of) the density of a conventional firearm projectile, such as a lead bullet (e.g., 11.2-11.3 g/cc), a Sinterfire™ (90Cu10Sn) bullet, etc.

Frangible firearm projectile 100 may have any suitable shape and size. When frangible firearm projectile 100 is designed to be loaded into a firearm cartridge 10, frangible firearm projectile 100 may have a suitable size and shape for loading into a firearm cartridge 10. For example, frangible firearm projectile 100 may take the form of a bullet, which forms the single projectile of a firearm cartridge that is configured to be fired from a rifle or pistol. As another example, frangible firearm projectile 100 may take the form of a shot pellet, a plurality of which may form the projectiles of a firearm cartridge in the form of a shot shell that is configured to be fired from a shotgun. As another example, projectile 100 may take the form of a shot slug, which may form the single projectile of a firearm cartridge in the form of a shot shell that is configured to be fired from a shotgun. As yet another example, a frangible firearm projectile 100 may take the form of a black powder bullet that is shaped and sized to be loaded into a firearm without first being assembled into a firearm cartridge that includes propellant. An assembled, unfired firearm cartridge 10 also may be referred to as firearm ammunition 10 or ammunition 10.

Figure 3:
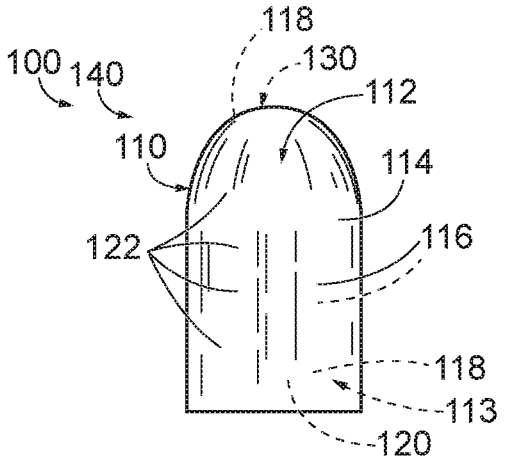
FIG. 3 is a schematic representation of a firearm projectile in the form of a bullet according to the present disclosure.
Figure 4:
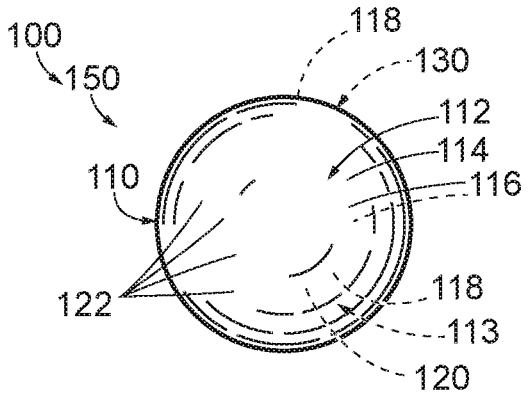
FIG. 4 is a schematic representation of a firearm projectile in the form of a shot pellet according to the present disclosure.

FIG. 3 provides a schematic example of a frangible firearm projectile 100 in the form of a bullet 140. FIG. 4 provides a schematic example of a frangible firearm projectile 100 in the form a shot pellet 150. Shot pellet 150 is illustrated in FIG. 4 as having a spherical configuration, but other shapes may be utilized. Examples of non-spherical shot pellet shapes include teardrop shapes, ovoid/elliptical shapes, ogived shapes, shapes that include a projecting tail region, shapes with one or more planar/faceted portions, and/or spherical shapes that include a center cylindrical band.

Figure 5:
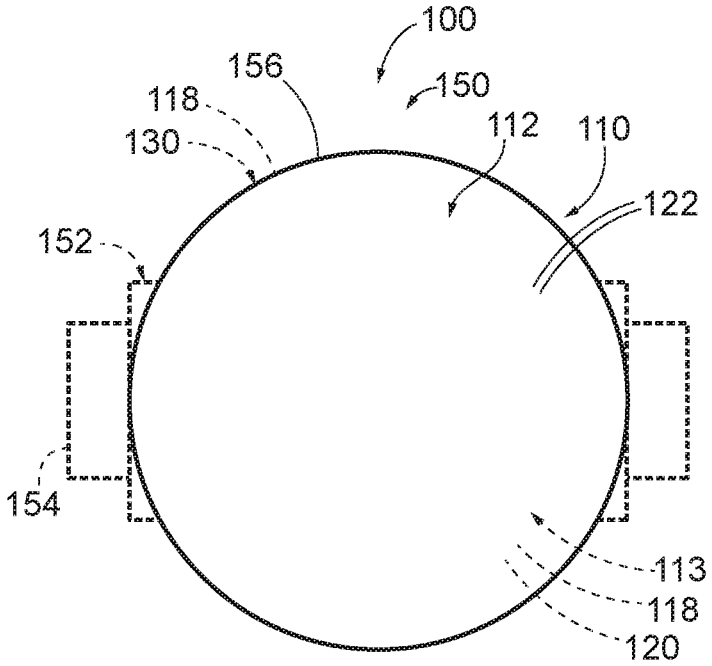
FIG. 5 is a schematic representation of a firearm projectile in the form of a shot pellet according to the present disclosure.

Examples of a firearm projectile 100 in the form of a shot pellet 150 with a projecting band are schematically illustrated in FIG. 5, with two different examples of projecting center bands indicated in dashed lines at 152 and 154. In some embodiments, the finished shot pellet may include some or a portion of the projecting band. In some embodiments, at least a portion of the projecting band is removed after the projectile is formed and heat-treated utilizing a method according to the present disclosure and before the shot pellet forms a portion of an assembled firearm cartridge 100. In FIG. 5, shot pellet 150 may be described as having generally opposed convex, or hemispherical, portions 156 that are separated by a generally cylindrical portion 152, 154. The diameter of the cylindrical portion may coincide with the diameter of the sphere that would otherwise be defined by the convex portions (as indicated by band 152), but it is also within the scope of the disclosure that the diameter of the cylinder is larger than the diameter of the sphere, such as indicated by band 154.

Thus, while FIGS. 3-5 provide less schematic examples of a bullet 140 and a shot pellet 150, actual bullets and shot pellets according to the present disclosure may have different shapes and/or sizes. For example, bullets 140 may be longer, may have a more pointed nose section, may have a recessed (hollow point) nose section, etc. As another example, shot pellet 150 may be non-spherical, may be ogived, may have one or more faceted surfaces, may have a tail, may include one or more dimples or recesses, etc. Thus, it is within the scope of the present disclosure that bullet 140 and shot pellet 150 may take any suitable shape and/or configuration, such as those known in the art for conventional bullets and shot pellets.

As discussed, although most shot shells include a plurality of shot, or shot pellets, such as shot pellets 150, some shot shells are designed to fire only a single firearm projectile. These firearm projectiles may be referred to as shot slugs, and the corresponding shot shells may be referred to as slug shells or shot slug shells. Furthermore, whereas individual shot pellets typically are dimensioned with a significantly smaller diameter than the inner diameter of the barrel from which they are fired and/or the interior diameter of the housing or casing in which the shot pellet is contained in the assembled firearm cartridge, a shot slug may be dimensioned to more closely correspond to the barrel so that the barrel may ballistically control the slug. In other words, shot slugs tend to be larger in diameter than shot pellets, thereby limiting lateral movement within a barrel when the slug is fired. In some embodiments, shot slugs may be configured to engage rifling of the barrel when fired (when fired from a firearm with a rifled barrel), thereby increasing the ballistic control of the shot slug. In other embodiments, the shot slugs are configured to be fired from smooth bore firearms, such as shot guns.

Shot slugs may have a diameter that is at least 80% of the diameter of the barrel of the firearm from which the slug is fired, with diameters of at least 90%, or even 95% to almost 100%, being more common. Shot slugs and their corresponding firearm cartridges 100 may be configured to be fired from shotguns that can also fire conventional shotgun shot or pellets. In further contrast to conventional shot and shot pellets, shot slugs have a defined orientation relative to the long axis of the barrel of the firearm from which they are fired. More specifically, shot slugs have defined forward and rearward ends. Therefore, while slugs may rotate about their longitudinal axes, the relative positions of these ends are not reversible as the slug travels within the firearm barrel. Shot slugs are also distinguishable from bullets, which are fired from pistols or rifles and which are at least partially surrounded by metal casings in the cartridge on account of the higher pressure and velocity that are typically encountered when the bullet cartridges are fired by these types of firearms.

Figure 6:
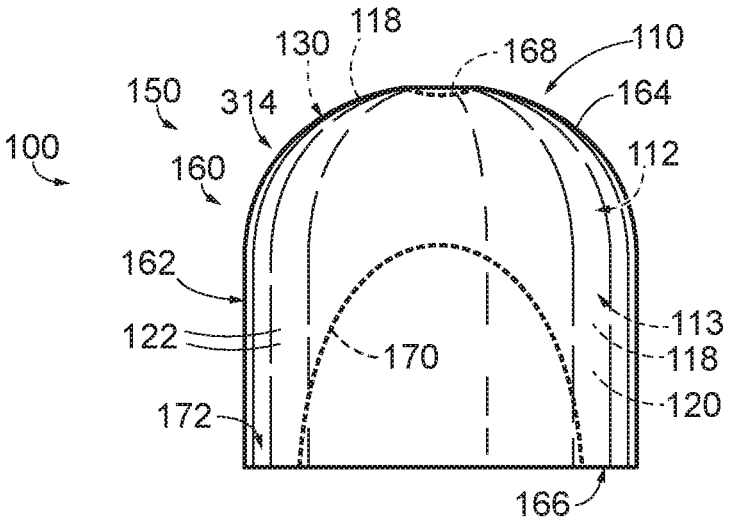
FIG. 6 is a schematic representation of a firearm projectile in the form of a shot slug according to the present disclosure.

An example of a firearm projectile 100 in the form of a shot pellet 150, and more particularly in the form of a shot slug, is shown in FIG. 6 and generally indicated at 160. In the following discussion, references to shot slug 160 refer generally to any firearm slug according to the present disclosure. As shown in FIG. 6, shot slug 160 includes a body 162 having a nose, or forward region, 164 and a base, or rearward region, 166. As used herein, the forward region refers to the portion of the slug that is designed to first leave the barrel of a firearm from which the shot slug is fired. Similarly, the base, or rearward region refers to the portion of the shot slug that is oriented toward the primer and propellant in a firearms cartridge and thereby is the last portion of the shot slug to leave the firearm barrel. In the illustrated example, the nose or forward region of the shot slug has a tapered, generally convex configuration, and the base or rearward region defines a flat, or generally planar, region. As depicted, shot slug 160 also includes an optional front internal recess 168 formed in forward region 164 and an optional rear internal recess 170 formed in rearward region 166.

It is within the scope of the disclosure, however, that shot slugs 160 according to the present disclosure may include only one of recesses 168 and 170, such as only a front internal recess, or more typically, only a rear internal recess. It is also within the scope of the disclosure that a slug may be formed without a front or rear recess, and in some embodiments, the slug may be shaped with other physical features. The front and rear internal recesses, when present, may be variously dimensioned. A particular size and shape of a particular recess may be chosen to impart the slug with desired ballistic characteristics. Body 162 of shot slug 160 includes a skirt 172, which extends radially outward from the longitudinal axis of the shot slug from rear recess 170 to the outer perimeter of the shot slug's body. The thickness of skirt 172, which defines, at least in part, the sidewalls of rear recess 170, may be sized to increase the effectiveness of the slug. For example, the skirt may be designed to be thick enough to allow the slug to remain intact when fired, and the skirt also may be tapered to help improve the structural stability of the slug. Front recess 168, when present, may increase flight trueness of the shot slug. Furthermore, the front recess may promote expansion and/or fragmentation of the shot slug when it strikes a deformable target.

As also shown in FIGS. 2-6, frangible firearm projectile 100 optionally may include a coating 130 that is applied to the exterior of the projectile, typically after formation of the plurality of discrete alloy domains. Examples of suitable coatings 130 include an oxidation-resistant coating, a corrosion-inhibiting coating, a spall-inhibiting coating, a surface-sealing coating, and/or an abrasion-resistant coating. Additionally or alternatively, coating 130 may include and/or be an anti-sparking agent, such as one petrolatum, borax, boric acid, zinc chloride, or one or more of the other previously discussed anti-sparking agents 118. Coating 130, when present, typically will be a further optional non-metallic component 113 of frangible firearm projectile 100 and may be applied through any suitable process, such as spraying and dipping. Thus, it is within the scope of the present disclosure that a frangible firearm projectile 100 may include an anti-sparking agent 118 interspersed or otherwise distributed within the body of the projectile and/or an anti-sparking agent 118 that is applied to the exterior of the frangible projectile body or otherwise forms at least a portion of a coating 130 on the exterior of the frangible projectile body.

Figure 7:
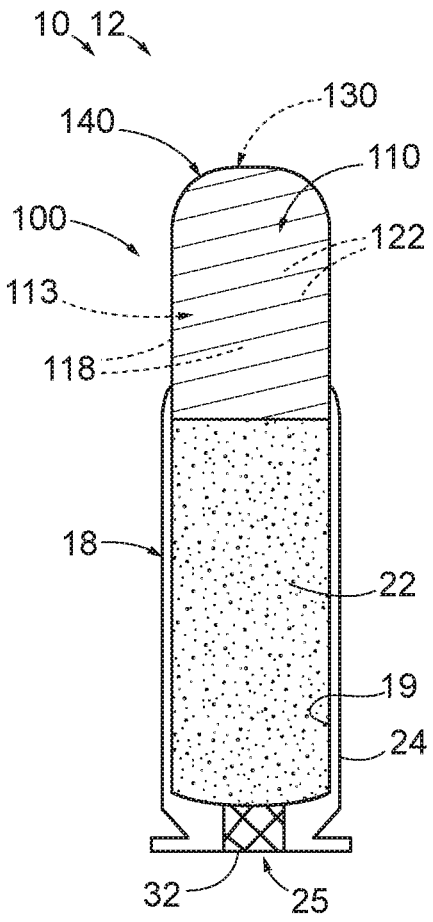
FIG. 7 is a schematic representation of a firearm cartridge in the form of a bullet cartridge that includes a firearm projectile in the form of a bullet according to the present disclosure.

FIG. 7 is a schematic example of a firearm cartridge 10 that includes a frangible firearm projectile 100 in the form of a bullet 140 according to the present disclosure. A firearm cartridge 10 that includes a bullet 140 may be referred to as a bullet cartridge 12. Bullet cartridge 12 also includes a casing, or housing, 18. Casing 18 includes a cup 19, or cup region 19, and defines an internal volume in which propellant 22 is located. Propellant 22 also may be referred to as powder 22, smokeless powder 22, gun powder 22, and/or charge 22. Bullet cartridge 12 additionally includes an ignition device 25, such as primer, or priming mixture, 32, which may be configured to ignite propellant 22. Casing 18, primer 32, and propellant 22 may be of any suitable materials, as is known in the firearm and ammunition fields.

Bullet cartridge 12 is configured to be loaded into a firearm, such as a handgun, rifle, or the like, and upon firing, discharges bullet 140 at high speeds and with a high rate of rotation due to rifling within the firearm's barrel. Although illustrated in FIG. 7 as a centerfire cartridge, in which primer 32 is located in the center of a base of casing 18, bullets 140 according to the present disclosure may also be incorporated into other types of cartridges, such as a rimfire cartridge, in which the casing is rimmed or flanged and the primer is located inside the rim of the casing.

Figure 8:
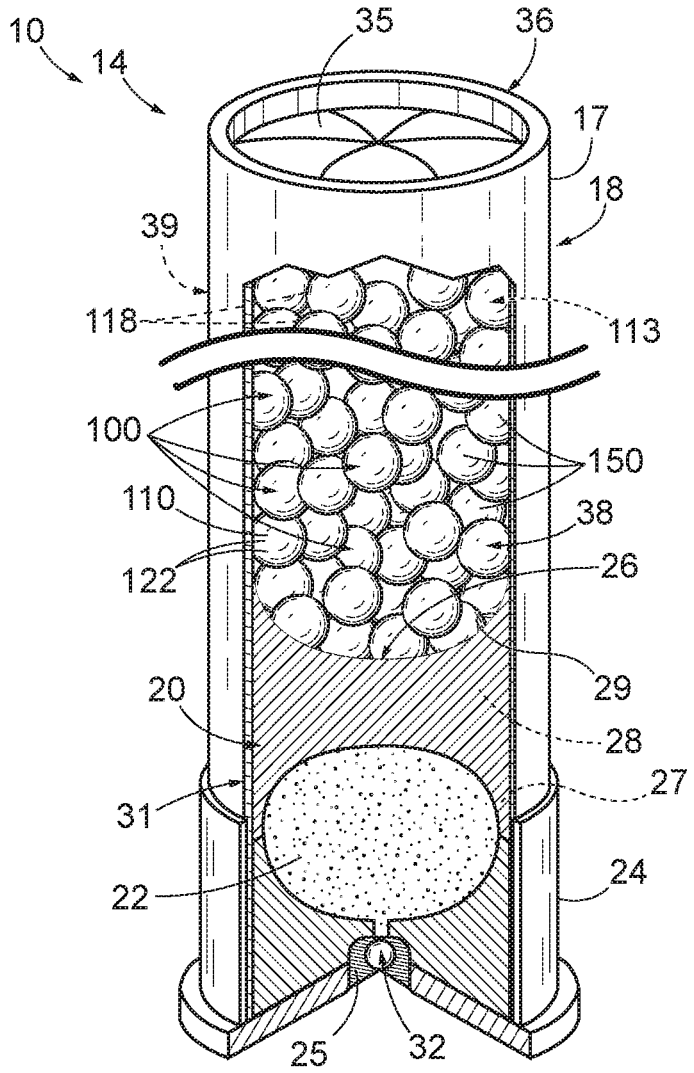
FIG. 8 is a schematic representation of a firearm cartridge in the form of a shot shell that contains a plurality of firearm projectiles in the form of shot pellets according to the present disclosure.

FIG. 8 is a schematic example of a firearm cartridge 10 that includes a plurality of firearm projectiles 100 in the form of shot pellets 150 according to the present disclosure. A firearm cartridge 10 that includes at least one shot pellet 150 may be referred to as a shot shell 14. With reference to FIG. 8, shot shell 14 is shown including a casing, or housing 18 with a head portion 24, a hull portion 17, and a mouth region 36. Shot shell 14 further includes an ignition device 25, such as primer, or priming mixture, 32, which may be configured to ignite propellant 22. Propellant 22 and primer 32 may be located behind a partition 20, such as a wad 31, which serves to segregate the propellant and the primer from a payload 38 of the shot shell and which may provide a gas seal to impede the flow of propellant gases during firing of the firearm cartridge.

Wad 31 may define and/or be described as defining a shot cup 26, which refers to a portion of the wad that generally faces toward mouth region 36 and which may be contacted by at least a portion of the plurality of shot pellets 150 in the assembled shot shell 14. Wad 31 additionally or alternatively may be referred to as a shot wad 31, and it may take a variety of suitable shapes and/or sizes. Any suitable size, shape, material, number of components, and/or construction of wad 31 may be used, including but not limited to conventional wads that have been used with lead shot, without departing from the scope of the present disclosure.

As indicated in FIG. 8, casing 18 may be described as defining an internal chamber, internal compartment, and/or enclosed volume of the shot shell. When the shot shell is assembled, at least propellant 22, wad 31, and payload 38 are inserted into the internal compartment, such as through mouth region 36. After insertion of these components into the internal compartment, mouth region 36 typically is sealed or otherwise closed, such as via any suitable closure 35. As an example, the region of the casing distal head portion 24 may be folded, crimped, or otherwise used to close mouth region 36.

Payload 38 additionally or alternatively may be referred to as a shot charge, or shot load, 38. Payload 38 typically will include a plurality of shot pellets 150. The region of shot shell 14, casing 18, and/or wad 31 that contains payload 38 may be referred to as a payload region 39 thereof.

Wad 31 defines a pellet-facing surface 29 that extends and/or faces generally toward mouth region 36 and away from head portion 24 (when the wad is positioned properly within an assembled shot shell). Wad 31 may include at least one gas seal, or gas seal region, 27, and at least one deformable region 28, between the payload region 39 and the propellant 22. Gas seal region 27 is configured to engage the inner surface of the shotgun's chamber and barrel to restrict the passage of gasses, which are produced when the shot shell is fired (i.e., when the charge is ignited), along the shotgun's barrel. By doing so, the gasses propel the wad, and the payload 38 of shot pellets 150 contained therein, from the chamber and along and out of the shotgun's barrel. Deformable region 28 is designed to crumple, collapse, or otherwise non-elastically deform in response to the setback, or firing, forces that are generated when the shot shell is fired and the combustion of the propellant rapidly urges the wad and payload from being stationary to travelling down the barrel of the shotgun at high speeds.

A shot shell 14 may include as few as a single shot pellet 150, which perhaps more appropriately may be referred to as a shot slug, and as many as dozens or hundreds of individual shot pellets 150. The number of shot pellets 150 in any particular shot shell 14 will be defined by such factors as the size and geometry of the shot pellets, the size and shape of the shell's casing and/or wad, the available volume in the casing to be filled by shot pellets 150, etc. For example, a 12-gauge double ought (00) buckshot shell typically contains nine shot pellets having diameters of approximately 0.3 inches (0.762 cm), while shot shells that are intended for use in hunting birds, and especially smaller birds, tend to contain many more shot pellets.

As discussed, shot shell 14 is designed and/or configured to be placed within a firearm, such as a shotgun, and to fire payload 38 therefrom. As an example, a firing pin of the firearm may strike primer 32, which may ignite propellant 22. Ignition of propellant 22 may produce gasses that may expand and provide a motive force to propel the one or more shot pellets 150 forming payload 38 from the firearm (or a barrel thereof).

Shot shell 14 and its components have been illustrated schematically in FIG. 8 and are not intended to require a specific shape, size, or quantity of the components thereof. The length and diameter of the overall shot shell 14 and its casing 18, the amount of primer 32 and propellant 22, the shape, size, and configuration of wad 31, the type, shape, size, and/or number of shot pellets 150, etc. all may vary within the scope of the present disclosure.

Figure 9:
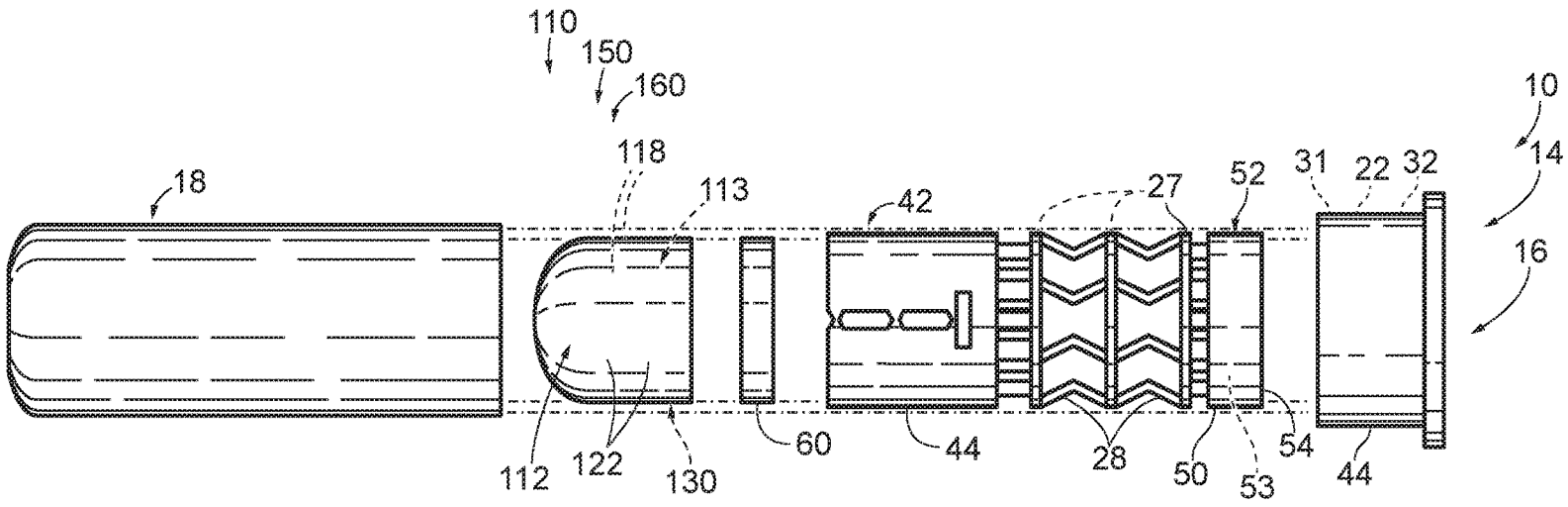
FIG. 9 is an exploded schematic representation of a firearm cartridge in the form of a shot slug shell that includes a firearm projectile in the form of a shot slug according to the present disclosure.
Figure 10:
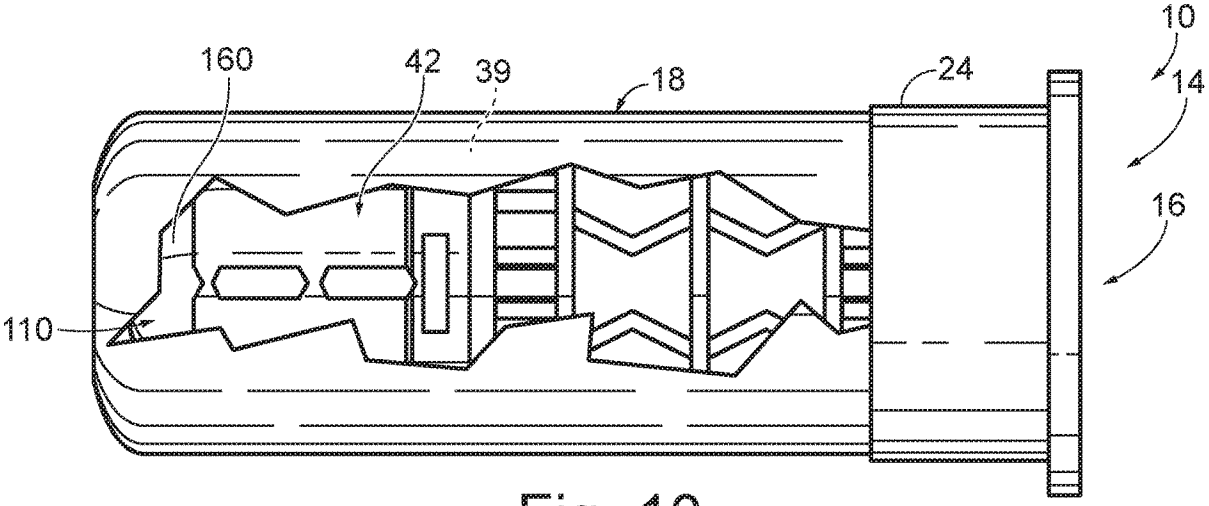
FIG. 10 is a fragmentary schematic representation of the firearm cartridge of FIG. 9.

FIGS. 9 and 10 illustrate an example of a firearm cartridge 10 in the form of a shot shell 14, and more particularly, in the form of a shot slug shell 16. As shown in FIG. 9, shot slug shell 16 includes many of the same components as shot shell 14 of FIG. 8. For example, shot slug shell 16 includes a case, or casing, 18 that often is formed from plastic and which defines a payload region 39. Shell 16 also includes a head portion 24, which is typically formed from metal and houses the shell's wad 31, charge 22, and priming mixture 32. The top of the hull (i.e., the portion that is distal head portion 24) typically is crimped closed, although other constructions and sealing methods may be used, including a construction in which the top of the casing forms a band with an opening having a smaller diameter than the shot slug and which is positioned over at least a portion of the nose of the shot slug. As discussed, a conventional shot slug shell is designed to house a single shot slug, which according to the present disclosure will be any of the slugs described, illustrated and/or incorporated herein. It is within the scope of the disclosure that shell 16 may include other constituent elements, that are conventional or otherwise known in the field of slug cartridge construction.

Shot slug shell 16 may, but is not required in all embodiments to, include a slug cup 42 within payload region 39. Slug cup 42 is configured to receive and house a shot slug 16 in a slug-engaging portion 44. Slug-engaging portion 44 may be shaped to closely correspond to the shape of shot slug 16, or at least a base portion thereof. In particular, in some embodiments, the slug-engaging portion may include ridges (not shown) complementarily configured relative to corresponding grooves on the surface of the shot slug. Such ridges may be located on the outer surface of the shot slug, the inner surface of a rear internal recess, and/or at the tail end of the shot slug.

Other mechanical and/or non-mechanical engagement mechanisms are within the scope of the disclosure. For example, these mechanisms include mechanisms in which the shot slug is seated within the slug cup but not mechanically locked or fixed relative to the slug cup, as well as mechanisms that are configured to create an enhanced friction between the shot slug and the cup, thus causing the shot slug to spin when the cup spins. To this end, the slug cup may be constructed to engage the rifling of a barrel. For example, the cup may be constructed from a material suitable for being fired down a barrel while engaging the rifling of the barrel. It has been found that nylon is well suited for engaging rifled barrels, although other materials may be used, such as polyethylene. The thickness of the slug cup may be dimensioned to increase the ability of the rifled barrel to impart spin on the cup and the shot slug. Furthermore, the slug cup may be configured for use in non-rifled barrels, and in some embodiments the same slug cartridge may be used in both rifled barrels and non-rifled barrels. The slug cup limits direct physical contact between the slug and the rifling, thus limiting potential harm the slug may cause to the rifling, especially in embodiments that do not utilize plating, which also may be used for engaging and/or protecting rifled barrels.

In FIG. 9, slug cup 42 also is shown with optional deformable region 28 (which additionally or alternatively may be referred to as a cushioning and/or shock-absorbing region 28) and at least one gas seal region 27. Gas seal region 27 may be attached to a firing cup 50. The firing cup and the gas seal region may collectively define a charge volume 52, which may be used to hold a charge, such as a quantity of gunpowder or other propellant 22. The firing cup may include a primer, or priming mixture, 32, which facilitates controlled ignition of the charge when firing the slug.

Slug shell 16 may further include a force distributor 60. In particular, force distributor 60 may be particularly suitable in embodiments in which the shot slug is frangible and/or includes a rear internal recess. The force distributor may be configured to withstand the force of firing, more evenly distribute the force of firing to the slug and/or limit clogging of the rear internal recess, such as with portions of the slug cup. The force distributor is typically constructed from a relatively rigid material, such as nylon or another strong polymer, thus limiting deformation of the force distributor when the slug is fired.

Shot slugs 16 according to the present disclosure also may be utilized in slug cartridges that include a sabot. Similar to the slug cup, a sabot at least partially encloses the shot slug while the shot slug is in the slug cartridge and after firing of the cartridge while the shot slug is still within the barrel of the firearm. However, once the shot slug has cleared the barrel, sabots may be designed to remain with or to separate from the shot slug. A sabot may be used to enhance rotation of the shot slug by providing a physical linkage between the rifling of a barrel and the shot slug.

As discussed, bullets 140, shot pellets 150, and shot slugs 160 are formed from compacted mixture 110 of metal powders 112, with compacted mixture 110 optionally including a coating 130 and/or non-metallic component 113 that is or includes an anti-sparking agent 118. As also discussed, compacted mixture 110 includes a plurality of discrete alloy domains 122. Thus, while each of these components may not be labelled in the firearm projectiles 100 of the firearm cartridges 10 of FIGS. 7-10, the components may be present since the firearm cartridges of FIGS. 7-10 include the firearm projectiles 100 of FIGS. 2-6.

Figure 11:
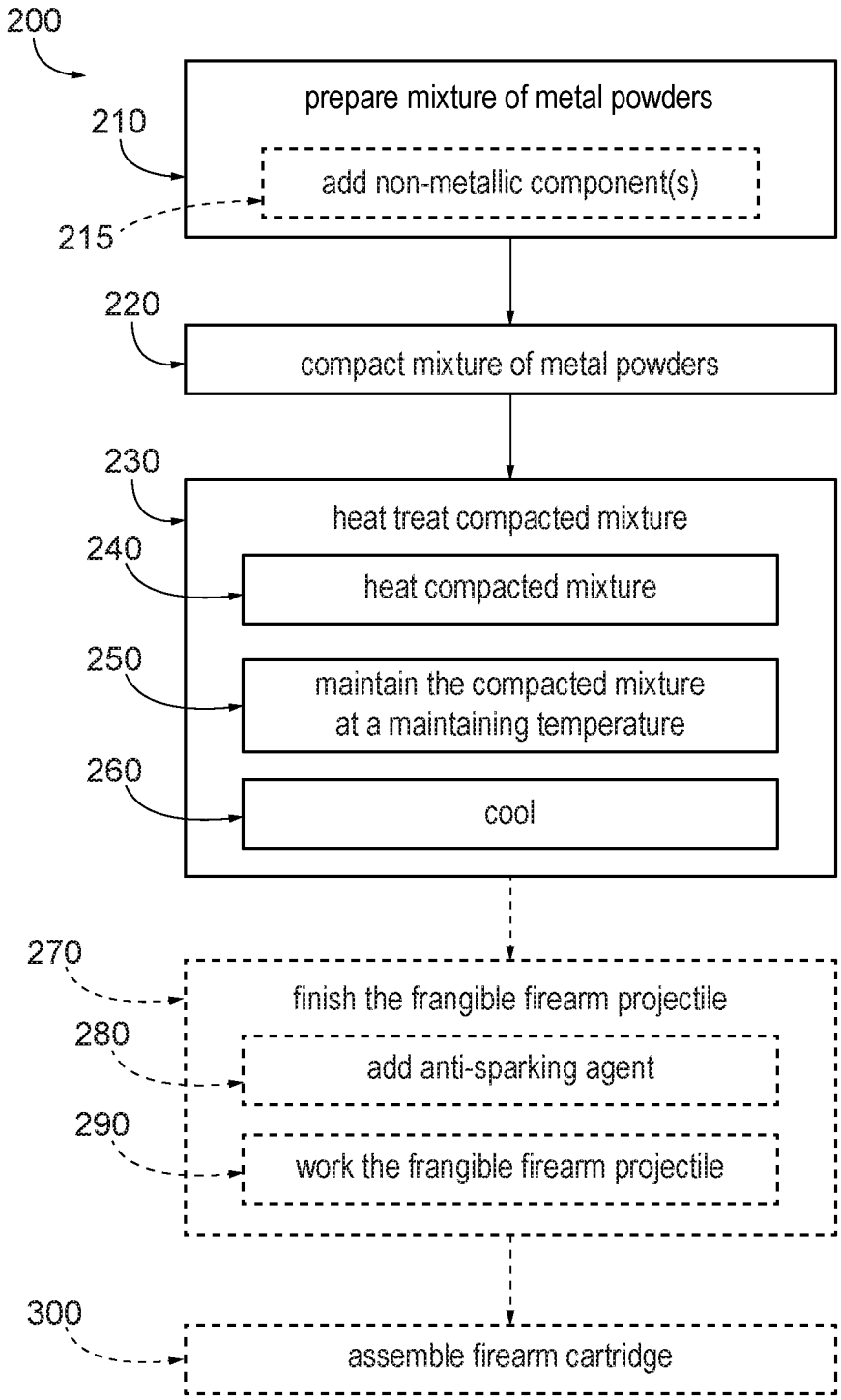
FIG. 11 is a flow chart illustrating methods for forming firearm projectiles and firearm cartridges according to the present disclosure.

FIG. 11 provides examples of methods 200 for forming frangible firearm projectiles 100 and firearm cartridges 10 containing the same according to the present disclosure. The methods presented in FIG. 11 are not intended to be exhaustive or required for production of all frangible firearm projectiles 100 and/or firearm cartridges 10 according to the present disclosure. Similarly, methods 200 may include additional steps and/or substeps without departing from the scope of the present disclosure. Unless a particular step must be completed to enable a subsequent step to be performed, the examples of steps shown and/or discussed in connection with FIG. 11 may be performed in any suitable concurrent and/or sequential order. In the following discussion reference numerals for the previously discussed compacted mixtures 110, frangible firearm projectiles 100, firearm cartridges 10 containing the same, and components thereof are utilized to provide references to the structures shown and discussed with respect to FIGS. 1-10 even though these reference numerals are not shown in FIG. 11.

At 210, a mixture of metal powders 112 is prepared. Preparing the mixture of metal powders 112 broadly refers to any preparatory steps to be ready to compact the mixture of metal powders 112 to form compacted mixture 110. Thus, the preparing may include obtaining a quantity of a previously prepared mixture of metal powders 112. However, preparing 210 also may include determining the metal powders 112 to be included in the mixture. For each of the one or more selected metals, this determining may include forming the metal powder, selecting a subset of the range of metal powder available, augmenting the distribution of particle sizes in the metal powder, obtaining the metal powder from a source, determining the relative percentage of the mixture of metal powders to be formed from the particular metal powder, etc. Preparing 210 may include blending or otherwise mixing the selected/obtained metal powders to form a desired mixture of the metal powders.

As indicated at 215, preparing 210 may include adding one or more non-metallic components 113, such as an anti-sparking agent 118 and/or a lubricant 120, to the mixture of metal powders, such as prior to the blending or other mixing step so that the anti-sparking agent and/or lubricant is more distributed within the mixture of metal powders. Preparing 210 may include pre-treatment of the metal powders, prior to and/or after mixing, such as to pre-heat and/or dry the metal powders. As another example, preparing 210 may include applying a pre-treatment coating to the powder particles.

At 220, the mixture of metal powders 112 (and anti-sparking agent 118, lubricant 120, and/or other non-metallic components 113, when present) is compacted to form compacted mixture 110 of metal powders. Any suitable manual or automated process and/or machinery may be utilized to form compacted mixture 110. As an example, a quantity of the mixture of metal powders may be flowed, poured, or otherwise loaded into a die. The die may define the shape, which may be a near-net shape or even final shape, of the desired frangible firearm projectile being produced. The mixture of metal powders in the die may then be compressed or otherwise compacted at a compaction pressure to form compacted mixture 110. Examples of compaction pressures are discussed herein.

At 230, the compacted mixture 110 of metal powders 112 is heat treated to form frangible firearm projectile 100. Thus, as a result of the heat treating, the plurality of discrete alloy domains 122 are formed within the compacted mixture and the resulting heat treated compacted mixture has the desired strength, density, and frangibility for frangible firearm projectile 100. As discussed herein, heat treating 230 includes heating the compacted mixture to a heating set point temperature (as indicated in FIG. 11 at 240), maintaining the heated compacted mixture at a maintaining temperature (that is at or near the heating set point temperature) for a maintaining time (as indicated at 250), and cooling the compacted mixture (as indicated at 260).

As used herein, the heating set point temperature also may be referred to as a hold temperature and/or a peak temperature. Heating 240 may be performed in any appropriate manner, such as by placing compacted mixture 110 in a furnace, oven, or other heating device. For brevity, the following discussion will refer to the heating device being utilized as a furnace. The heating set point temperature at which the compacted mixture 110 is heated should be sufficiently high to promote the formation of the discrete alloy domains 122 within the compacted mixture of metal powders, such as via one or more of the non-liquid-phase mechanisms discussed herein, while not melting any of the metal powders of the compacted mixture of metal powders. In other words, the compacted mixture of metal powders should be heated at a heating set point temperature and (via maintaining 250) for a maintaining time sufficient to cause sufficient (non-liquid-phase) diffusion bonding of the metals present in the compacted mixture of metal powders to sufficiently strengthen the compacted mixture of metal powders for use as firearm projectile 100 without overly heating the compacted mixture of metal powders to render it not frangible. In addition, the compacted mixture should be heated at a rate, to a heating set point temperature, and for a maintaining time that regulates the oxidation of the metal powders to create sufficient chemical bonds to strengthen the resulting frangible firearm projectile without detrimentally affecting the properties (e.g., strength, density, frangibility, and/or dimensional stability) of the frangible firearm projectile.

For example, the heating set point temperature may be selected to be lower than the lowest melting point of any of the metal powders present in the compacted mixture of metal powders. When such a heating set point temperature is utilized, it may be at least 5° C., at least 10° C., at least 15° C., at least 20° C., at least 25° C., at most 30° C., at most 25° C., at most 20° C., and/or at most 15° C. below the lowest melting point of the metal powders present in the compacted mixture of metal powders. As more specific examples, the heating set point temperature may be at least at least 200° C., at least 250° C., at least 260° C., at least 270° C., at least 280° C., at least 300° C., at least 350° C., at least 400° C., at most 404.4° C., at most 390° C., at most 375° C., at most 325° C., at most 275° C., in the range of 200-405° C., in the range of 225-400° C., and/or in the range of 250-400° C. A temperature that is equal to or even greater than the lowest melting point of the metal powders present in the compacted mixture of metal powders may be utilized, provided that the compacted mixture of metal powders is not heated for a time sufficient to melt the metal powders in the compacted mixture of metal powders.

The heating set point temperature and the maintaining time should be selected such that the discrete alloy domains 122 are formed to provide the frangible firearm projectile 100 with sufficient strength to remain intact during manufacturing, automated loading/assembly into a firearm cartridge 10, and subsequent packaging and transport of the firearm cartridge. However, the heating set point temperature and time also should be selected such that they do not result in melting any of the metal powders or forming sufficiently large and/or numerous alloy domains that the projectile ceases to be frangible. As examples, the time during which the compacted mixture of metal powders is heated may be at least 5 minutes, at least 10 minutes, at least 15 minutes, at least 20 minutes, at least 30 minutes, at least 45 minutes, at least 60 minutes, at least 120 minutes, at least 180 minutes, at least 240 minutes, at least 300 minutes, at most 360 minutes, at most 330 minutes, at most 270 minutes, at most 210 minutes, at most 150 minutes, at most 100 minutes, at most 75 minutes, at most 50 minutes, at most 40 minutes, at most 30 minutes, in the range of 10-30 minutes, and/or in the range of 20-60 minutes.

Additionally or alternatively, the time during which the compacted mixture of metal powders is heated at 230 may be described as including a heating phase, in which the temperature of the compacted mixture of metal powders is increased at a generally constant heating rate, and a maintaining phase, in which the temperature of the compacted mixture of metal powders is held at a generally constant temperature, such as the heating set point temperature or a temperature within 1%, 3%, 5%, and/or 10% of the heating set point temperature. The maintaining phase additionally or alternatively may be referred to as a temperature hold phase. As examples, the heating rate may be at least 0.5° C./minute, at least 1° C./minute, at least 1.5° C./minute, at least 2° C./minute, at least 2.5° C./minute, at least 3.0° C./minute, at least 3.5° C./minute, at least 4.0° C./minute, at least 4.5° C./minute, at most 5° C./minute, at most 4.5° C./minute, at most 4° C./minute, at most 3.5° C./minute, at most 3° C./minute, in the range of 0.5-1.5° C./minute, in the range of 1-2° C./minute, in the range of 1.5-2.5° C./minute, in the range of 2-3° C./minute, in the of range 2-4° C./minute, in the range of 1-5° C./minute, in the range of 3-5° C./minute, and/or in the range of 4-5° C./minute.

The heating rate may correspond to a rate at which a temperature of compacted mixture 110 rises during the heating phase, and/or may correspond to a rate at which the temperature of the furnace is raised during the heating phase. For example, the heating phase may include raising the temperature of compacted mixture 110 by raising the temperature of the furnace from a base temperature to the heating set point temperature, such that the temperature of the compacted mixture is equal, or at least substantially equal, to the temperature of the furnace during the heating phase. As another example, the heating phase may include raising the temperature of compacted mixture 110 to the heating set point temperature by placing the compacted mixture into the furnace when the furnace is at the heating set point temperature, such that the heating phase corresponds to the compacted mixture reaching the heating set point temperature while the temperature of the furnace stays constant, or at least substantially constant. As further examples, the duration of the heating phase and/or of the temperature hold phase may be at least 5 minutes, at least 10 minutes, at least 15 minutes, at least 20 minutes, at least 30 minutes, at least 45 minutes, at least 60 minutes, at least 120 minutes, at least 180 minutes, at least 240 minutes, at least 300 minutes, at most 360 minutes, at most 330 minutes, at most 270 minutes, at most 210 minutes, at most 150 minutes, at most 100 minutes, at most 75 minutes, at most 50 minutes, at most 40 minutes, at most 30 minutes, in the range of 10-30 minutes, and/or in the range of 20-60 minutes. In some embodiments, the heat treating 230 may include heating the compacted mixture to an intermediate heating set point temperature that is less than the heating set point temperature and maintaining the heated compacted mixture at the intermediate heating set point temperature for an intermediate temperature hold time before heating the compacted mixture to the heating set point temperature.

The heat treating 230 of the compacted mixture 110 of metal powders 112 may be performed in air or otherwise not in a specialized (i.e., oxygen-rich, hydrogen-rich, inert, nitrogen-rich, vacuum, etc.) atmosphere. However, heating of compacted mixture 110 of metal powders 112 in a specialized atmosphere is still within the scope of the present disclosure.

After the plurality of discrete alloy domains 122 are formed, compacted mixture 110 may be referred to as frangible firearm projectile 100. Although additional steps may be performed, examples of which are described herein, the frangible firearm projectile has been formed after the plurality of discrete alloy domains are formed in the compacted mixture while retaining the frangibility of the frangible firearm projectile.

At 260, the heated compacted mixture 110 with the plurality of discrete alloy domains 122 is permitted to cool, such as to room temperature. The cooling time may depend upon the temperature of the frangible firearm projectile, any further processing to be performed, a desired temperature at which any further processing is to be performed, the availability of personnel, materials, and/or equipment to perform any additional processing, etc. Cooling 260 may involve simply not continuing to apply heat to the frangible firearm projectile, although it is within the scope of the disclosure that cooling 260 additionally or alternatively may include taking positive steps to cool the frangible firearm projectile. Stated differently, the cooling 260 may include one or more active cooling steps and/or one or more passive cooling steps. An example of an active cooling step is using a fan or blower to apply an ambient or below-ambient air or other fluid stream to the frangible firearm projectile. Additionally or alternatively, an active cooling step may include cooling the frangible firearm projectile 100 at a faster rate than would be achieved by simply not continuing to heat the frangible firearm projectile, or may include regulating the cooling rate of the frangible firearm projectile such that the cooling rate is slower than would be achieved by simply not continuing to heat the frangible firearm projectile.

Cooling 260 may include an active cooling step in series with a passive cooling step. For example, cooling 260 may include an active cooling step performed for an active cooling time interval and/or until the frangible firearm projectile 100 reaches a cooling set point temperature, followed by a passive cooling step, such as allowing the frangible firearm projectile 100 to approach and/or reach an ambient air temperature.

As a more specific example, cooling 260 may include bringing frangible firearm projectile 100 to the cooling set point temperature in the furnace and at a positive cooling rate, and subsequently may include removing the compacted mixture from the furnace and/or exposing the compacted mixture to an ambient air temperature. As more specific examples, the active cooling time interval may be at least 10 minutes, at least 20 minutes, at least 30 minutes, at least 60 minutes, at least 90 minutes, at least 120 minutes, at least 150 minutes, at most 180 minutes, at most 165 minutes, at most 135 minutes, at most 105 minutes, at most 75 minutes, at most 45 minutes, and/or at most 15 minutes. Additionally or alternatively, the cooling threshold temperature may be at least 100° C., at least 150° C., at least 200° C., at least 250° C., at least 300° C., at least 350° C., at most 375° C., at most 325° C., at most 275° C., at most 250° C., at most 225° C., at most 175° C., at most 125° C., in the range of 100-300° C., and/or in the range of 150-250° C. As examples, the active cooling rate may be at least 0.5° C./minute, at least 1° C./minute, at least 1.5° C./minute, at least 2° C./minute, at least 2.5° C./minute, at least 3.0° C./minute, at least 3.5° C./minute, at least 4.0° C./minute, at least 4.5° C./minute, at most 5° C./minute, at most 4.5° C./minute, at most 4° C./minute, at most 3.5° C./minute, at most 3° C./minute, in the range of 0.5-1.5° C./minute, in the range of 1-2° C./minute, in the range of 1.5-2.5° C./minute, in the range of 2-3° C./minute, in the range of 2-4° C./minute, in the range of 1-5° C./minute, in the range of 3-5° C./minute, and/or in the range of 4-5° C./minute.

At 270, one or more finishing steps may be performed on or applied to the frangible firearm projectile 100. For example, the finishing 270 may include applying a coating (such as coating 130) to the frangible firearm projectile. As discussed, the coating may be and/or include an anti-sparking agent 118. The applying the coating may be performed in any appropriate manner, examples of which include spraying the frangible firearm projectile with the coating and/or dipping the frangible firearm projectile in the coating. As a more specific example, the applying the coating may include passing the frangible firearm projectile through a bath that includes the coating, such as via a bucket elevator, and further may include homogenizing a thickness of the coating on the frangible firearm projectile, such as with a device configured for this purpose. The applying the coating also may include, prior to the passing the frangible firearm projectile through the bath, heating the bath to a temperature sufficient to melt and/or liquefy the components of the coating. As examples, the heating the bath may include heating the coating to a temperature of at least 50° C., at least 65° C., at least 75° C., at least 85° C., at least 100° C., at least 125° C., at least 150° C., at least 175° C., at least 200° C., at most 225° C., at most 180° C., at most 160° C., at most 130° C., at most 90° C., at most 80° C., at most 70° C., and/or at most 60° C.

As another example, the finishing 270 may include working 290 the frangible firearm projectile to adjust the final shape of the frangible firearm projectile. This working may include tumbling the projectile (typically with additional projectiles and/or tumbling media) to remove die lines or other residual projections or indentations that are desired to be reduced in size or even removed prior to assembly of a firearm cartridge 10 that contains the frangible firearm projectile 100. Additionally or alternatively, the working may include grinding or shaping a portion of the frangible firearm projectile 100, such as to adjust the shape thereof prior to assembly of a firearm cartridge 10 that contains the frangible firearm projectile 100.

At 300, a firearm cartridge 10, such as a bullet cartridge 12, a shot shell 14, or a slug shell 16 may be assembled that contains at least one frangible firearm projectile 100. Assembling of the firearm cartridge additionally or alternatively may be referred to as loading or forming the firearm cartridge.

A variety of factors may be considered when determining the composition of a frangible firearm projectile 100 and/or a method 200 to be utilized, some of which already have been discussed herein. Additional examples of factors include the metal(s) to be utilized, the particle size and/or size distribution of the powder(s), the chemistry/properties of the selected powders, the amount and type of anti-sparking agent (if any) to be utilized, the amount and type of lubricant (if any) to be utilized, the compaction pressure, the desired density of the frangible firearm projectile, the temperature at which the compacted mixture is heated, the duration for which the compacted mixture is heated and/or maintained at or near the heating set point temperature, the type of frangible firearm projectile being formed, the type of firearm cartridge into which the frangible firearm projectile will be loaded, any post-heating treatment of the frangible firearm projectile, etc.

When considering the metals to be utilized and the particle sizes of the metal powders, consideration may be made of the density of the powders, the flowability of the powders, the melting points of the powders, the compactability of the powders, and/or the ease/difficulty with which the metals form chemical bonds. As examples, nickel, bismuth, tungsten, and copper are denser than iron, zinc, and steel, so utilizing these metals may increase the density of the frangible firearm projectile. Particle size may be a related consideration, as powders of softer metals like tin and zinc may flow into voids in the compacted mixture more easily than iron powder, which may impede the filling of voids in the compacted mixture and thus reduce the density of the produced frangible firearm projectile. Thus, the density of the produced frangible firearm projectile may be increased if more fine particles of a softer metal are utilized and/or if fewer fine particles of a harder metal are utilized.

Another metal-based factor is how easy or difficult it is to form alloys with the selected metals. For example, copper forms alloys very easily, and thus may be prone to forming too many and/or too large of alloy domains. When this occurs, the resulting firearm projectile may not be frangible. On the other hand, tin and bismuth generally do not easily form alloys (i.e., are more difficult to form alloys with than copper) and thus may promote increased frangibility because the alloy domains are slower to form and grow.

Yet another factor is the rate and/or temperature at which the selected metals form oxides and the resulting effect of such oxides on the strength, frangibility, dimensions, and/or density of the resulting frangible firearm projectile. For example, heating zinc oxide to too high of a temperature, too quickly, or for too long may negatively affect these properties of the firearm projectile.

A further metal-based factor that may be considered is the expense of the metal powders. For example, as of the priority date of this application, iron powder is less expensive than the other powders discussed herein, and tin, bismuth, nickel, and tungsten are the most expensive of the powders discussed herein.

When considering whether and/or how much lubricant to include, adding some lubricant may increase the overall density of the frangible firearm projectile (by enabling the powders to compact more densely) and/or the ease with which the mixture of metal powders is flowed into a die, removed from a die, etc. In experiments, using less than the 2% that commonly is used in powder metallurgy processes has been demonstrated to be advantageous in some embodiments. Using an excess of lubricant, such as more than 2%, may reduce the overall density of the frangible firearm projectile by adding too much low density material to the projectile.

Additionally, when compacted mixture 110 includes an anti-sparking agent in the form of borate, such as boric acid and/or borax, a consideration regarding an appropriate proportion of borate in the compacted mixture may introduce a tradeoff between material strength and undesirable material properties. In experiments, using boric acid and/or borax up to at least 2% (by weight) improves the strength of the frangible firearm projectile 100 compared to a frangible firearm projectile that is otherwise identical in composition and formation method except for the exclusion of anti-sparking agent (for example, as measured by a crushing force of the frangible firearm projectile). However, an excess of anti-sparking agent, like an excess of lubricant, may decrease the density of the compacted firearm projectile to an unacceptable value. Also, these additives may migrate to, or toward, the surface of the compacted firearm projectile during heating if the heating parameters are not appropriately selected. In addition, experiments demonstrate that introduction of a borate may lower the melting point and fluidity of zinc in compacted mixture 110, thus encouraging the formation of the iron-zinc alloy when iron also is present in compacted mixture 110. To counteract this effect, appropriate adjustments to the heating parameters (e.g., total time, maximum temperature, heating ramp, cooling, etc.) may be made to ensure that frangible firearm projectile 100 formed of compacted mixture 110 remains sufficiently frangible.

Increasing the temperature and/or time at/during which the compacted mixture is heated will tend to increase the vapor-phase diffusion bonding that occurs within the compacted mixture of metal powders. Additional diffusion bonding should increase the strength of the resulting frangible firearm projectile, but as the degree of diffusion bonding increases, the frangibility of the firearm projectile will tend to decrease. Thus, there may be competing tradeoffs between strength and frangibility. Also, melting of any of the metal powders will cause a distinct decrease in the frangibility of the firearm projectile.

Experiments were performed to demonstrate how some of the above-discussed factors affect the resulting properties of the produced frangible firearm projectiles 100. In these experiments, compacted mixtures 110 were formed and heated to generate discrete alloy domains 122 within the compacted mixtures. Representative results from these experiments are shown below, with the trial numbers in each table corresponding to each other. Stated differently, each trial represented in the following tables has been assigned an index number that appears in each table such that data corresponding to a given trial may be represented in each of the plurality of tables. As represented in the tables below, an empty table entry is not intended to indicate, suggest, and/or imply that the corresponding datum is not applicable, irrelevant, and/or nonexistent. As represented in the following table, the weight percentage of borate indicated for each trial corresponds to a weight percentage of boric acid alone, unless otherwise indicated.

TABLE 1

| No. | Composition (wt %) | Borate (wt %) | Wax (wt %) | Zinc Powder Particle Size | Density (g/cc) |
|---|---|---|---|---|---|
| 1 | 89% Fe/11% Zn | | 0.0% | | 6.70 |
| 2 | 89% Fe/11% Zn | | 0.0% | | 6.75 |
| 3 | 89% Fe/11% Zn | | 0.0% | | 6.60 |
| 4 | 95% Fe/5% Zn | | 0.0% | | 6.10 |
| 5 | 85% Fe/15% Zn | | 0.0% | | 6.70 |
| 6 | 95% Fe/5% Sn | | 0.0% | | 6.63 |
| 7 | 85% Fe/15% Sn | | 0.0% | | 6.60 |
| 8 | 85% Fe/6% Sn/9% Bi | | 0.0% | | 7.00 |
| 9 | 85% Fe/9% Sn/6% Bi | | 0.0% | | 6.90 |
| 10 | 95% Cu/5% Zn | | 0.0% | | 7.25 |
| 11 | 85% Fe/15% Cu | | 0.0% | | 6.45 |
| 12 | 85% Fe/15% Zn | | 0.0% | | 6.93 |
| 13 | 80% Fe/20% Zn | | 0.0% | | 7.17 |
| 14 | 85% Fe/15% Zn | | 0.4% | | 7.20 |
| 15 | 80% Fe/15% Zn/5% Bi | | 0.4% | | 7.40 |
| 16 | 85% Fe/15% Zn | | 0.4% | | 7.10 |
| 17 | 85% Fe/15% Zn | | 1.0% | | 7.10 |
| 18 | 85% Fe/15% Zn | | 2.0% | | 7.00 |
| 19 | 85% Fe/15% Zn | | 0.4% | | 7.20 |
| 20 | 85% Fe/15% Zn | | 0.4% | | 7.00 |
| 21 | 85% Fe/15% Zn | | 0.4% | | 7.10 |
| 22 | 85% Fe/15% Zn | | 0.4% | | 7.10 |
| 23 | 50% Fe/50% Zn | | 0.40% | −60 + 140 mesh | |
| 24 | 50% Fe/50% Zn | | 0.30% | +60 mesh | |
| 25 | 50% Fe/50% Zn | | 0.30% | −60 + 140 mesh | |
| 26 | 85% Fe/15% Zn | | 0.30% | +60 mesh | |
| 27 | 85% Fe/15% Zn | | 0.30% | −60 + 140 mesh | |
| 28 | 85% Fe/15% Zn | | 0.30% | −325 mesh | |
| 29 | 85% Fe/15% Zn | | 0.30% | +60 mesh | |
| 30 | 85% Fe/15% Zn | | 0.30% | −60 + 140 mesh | |
| 31 | 85% Fe/15% Zn | | 0.30% | −325 mesh | |
| 32 | 85% Fe/15% Zn | | 0.30% | +60 mesh | |
| 33 | 85% Fe/15% Zn | | 0.30% | −60 + 140 mesh | |
| 34 | 50% Fe/50% Zn | | 0.30% | +60 mesh | |
| 35 | 50% Fe/50% Zn | | 0.30% | −60 + 140 mesh | |
| 36 | 50% Fe/50% Zn | | 0.30% | −325 mesh | |
| 37 | 50% Fe/50% Zn | | 0.30% | +60 mesh | |
| 38 | 50% Fe/50% Zn | | 0.30% | −60 + 140 mesh | |
| 39 | 50% Fe/50% Zn | | 0.30% | −325 mesh | |

TABLE 1-continued

| No. | Composition (wt %) | Borate (wt %) | Wax (wt %) | Zinc Powder Particle Size | Density (g/cc) |
|---|---|---|---|---|---|
| 40 | 50% Fe/50% Zn | | 0.30% | +60 mesh | |
| 41 | 50% Fe/50% Zn | | 0.30% | −60 + 140 mesh | |
| 42 | 50% Fe/50% Zn | | 0.30% | −325 mesh | |
| 43 | 20% Fe/80% Zn | | 0.30% | +60 mesh | |
| 44 | 20% Fe/80% Zn | | 0.30% | −60 + 140 mesh | |
| 45 | 20% Fe/80% Zn | | 0.30% | −325 mesh | |
| 46 | 20% Fe/80% Zn | | 0.30% | +60 mesh | |
| 47 | 20% Fe/80% Zn | | 0.30% | −60 + 140 mesh | |
| 48 | 20% Fe/80% Zn | | 0.30% | −325 mesh | |
| 49 | 20% Fe/80% Zn | | 0.30% | +60 mesh | |
| 50 | 20% Fe/80% Zn | | 0.30% | −60 + 140 mesh | |
| 51 | 20% Fe/80% Zn | | 0.30% | −325 mesh | |
| 52 | 85% Fe/15% Zn | | 0.30% | −60 + 140 mesh | |
| 53 | 85% Fe/15% Zn | | 0.30% | +60 mesh | |
| 54 | 85% Fe/15% Zn | | 0.30% | −60 + 140 mesh | |
| 55 | 85% Fe/15% Zn | | 0.30% | +60 mesh | |
| 56 | 85% Fe/15% Zn | | 0.30% | −80 + 140 mesh | |
| 57 | 85% Fe/15% Zn | | 0.30% | +200 mesh | |
| 58 | 85% Fe/15% Zn | | 0.30% | −40 + 200 mesh | |
| 59 | 85% Fe/15% Zn | | 0.30% | −80 + 140 mesh | |
| 60 | 85% Fe/15% Zn | | 0.30% | | |
| 61 | 85% Fe/15% Zn | | 0.30% | +200 mesh | |
| 62 | 85% Fe/15% Zn | | 0.30% | −80 + 140 mesh | |
| 63 | 85% Fe/15% Zn | | 0.30% | +60 mesh | |
| 64 | 85% Fe/15% Zn | | 0.30% | | |
| 65 | 75% Fe/25% Zn | | 0.30% | −80 + 140 mesh | |
| 66 | 50% Fe/50% Zn | | 0.30% | −80 + 140 mesh | |
| 67 | 50% Fe/50% Zn | | 0.30% | −80 + 140 mesh | |
| 68 | 50% Fe/50% Zn | | 0.30% | −80 + 140 mesh | |
| 69 | 50% Fe/50% Zn | | 0.30% | +60 mesh | |
| 70 | 75% Fe/15% Zn/10% Brass | | 0.30% | −80 + 140 mesh | |
| 71 | 50% Fe/50% Zn | | 0.30% | −80 + 140 mesh | |
| 72 | 50% Fe/40% Zn/10% Brass | | 0.30% | −80 + 140 mesh | |
| 73 | 50% Fe/50% Zn | | 0.30% | −80 + 140 mesh | |
| 74 | 50% Fe/50% Zn | | 0.30% | +60 mesh | |
| 75 | 50% Fe/50% Zn | | 0.30% | −80 + 140 mesh | |
| 76 | 75% Fe/25% Zn/5% Sn | | 0.30% | Grease grade −325 mesh | |
| 77 | 80% Fe/20% Zn | | 0.30% | Grease grade −325 mesh | |
| 78 | 50% Fe/50% Zn | | 0.30% | −80 + 140 mesh | |
| 79 | 75% Fe/20% Zn/5% Sn | | 0.30% | Grease grade −325 mesh | |
| 80 | 80% Fe/20% Zn | | 0.30% | Grease grade −325 mesh | |
| 81 | 50% Fe/40% Zn/10% Brass | | 0.30% | −80 + 140 mesh | |
| 82 | 65% Fe/25% Zn/10% Sn | | 0.30% | −80 + 140 mesh | |
| 83 | 80% Fe/20% Zn | | 0.30% | Grease grade −325 mesh | |
| 84 | 75% Fe/25% Zn | | 0.30% | −80 + 140 mesh | |
| 85 | 80% Fe/20% Zn | | 0.30% | Grease grade −325 mesh | |
| 86 | 80% Fe/20% Zn | | 0% | Grease grade −325 mesh | |
| 87 | 80% Fe/20% Zn | | 0.30% | Grease grade −325 mesh | |
| 88 | 80% Fe/20% Zn | | 0.10% | Grease grade −325 mesh | |
| 89 | 80% Fe/20% Zn | | 0.10% | Grease grade −325 mesh | |
| 90 | 80% Fe/20% Zn | | 0.20% | Grease grade −325 mesh | |
| 91 | 70% Fe/30% Zn | | 0.20% | Grease grade −325 mesh | |
| 92 | 10% Fe/90% Zn (Nose-20 Gr), 80% Fe/20% Zn (Body) | | 0.20% | −80 + 140 mesh (Nose), grease grade −325 mesh (Body) | |
| 93 | 80% Fe/20% Zn | | 0.20% | Grease grade −325 mesh | |
| 94 | 10% Fe/90% Zn (Nose-20 Gr), 80% Fe/20% Zn (Body-80 Gr) | | 0.20% | −80 + 140 mesh (Nose), grease grade −325 mesh (Body) | |
| 95 | 100% Fe | | 0.20% | N/A | |

TABLE 1-continued

| No. | Composition (wt %) | Borate (wt %) | Wax (wt %) | Zinc Powder Particle Size | Density (g/cc) |
|---|---|---|---|---|---|
| 96 | 10% Fe/90% Zn (Nose-30 Gr), 85% Fe/15% Zn (Body-70 Gr) | | 0.20% | −140 + 325 mesh (Nose), −60 + 140 (Body) | |
| 97 | 82% Fe/13% Zn/5% Al | | 0.20% | −80 + 140 mesh | |
| 98 | 100% Fe | | 0.20% | | |
| 99 | 50% Fe/50% Zn | | 0.20% | −60 + 140 mesh | |
| 100 | 80% Fe/19% Zn/1% Al | | 0.20% | −60 + 140 mesh | |
| 101 | 85% Fe/15% Zn (95 Gr with 5 Gr Cu on bottom) | | 0.20% | −60 + 140 mesh | |
| 102 | 85% Fe/15% Zn (90 Gr with 10 Gr Cu on bottom) | | 0.20% | −60 + 140 mesh | |
| 103 | 85% Fe/15% Zn (90 Gr with 10 Gr Zn on bottom) | | 0.20% | −60 + 140 mesh (Body), +60 on bottom | |
| 104 | 85% Fe/15% Zn | 1% | 0.20% | −60 + 140 mesh | |
| 105 | 85% Fe/15% Zn | 1.50% | 0.20% | −60 + 140 mesh | |
| 106 | 85% Fe/15% Zn | 2% | 0.20% | −60 + 140 mesh | |
| 107 | 85% Fe/15% Zn | 2% | 0.10% | −60 + 140 mesh | |
| 108 | 85% Fe/15% Zn | 2% | 0.10% | −60 + 140 mesh | |
| 109 | 85% Fe/15% Zn | 2% | 0.10% | −60 + 140 mesh | |
| 110 | 80% Fe/20% Zn | 2% | 0.20% | Grease grade −325 mesh | |
| 111 | 50% Fe/50% Zn | 2% | 0.20% | −60 + 140 mesh | |
| 112 | 85% Fe/15% Zn | 2% | 0.20% | −60 + 140 mesh | |
| 113 | 85% Fe/15% Zn | 2% | 0.15% | −60 + 140 mesh | |
| 114 | 80% Fe/20% Zn | 2% | 0.15% | −60 + 140 mesh | |
| 115 | 85% Fe/15% Zn | 2% | 0.15% | −60 + 140 mesh | |
| 116 | 75% Fe/25% Zn | 2% | 0.20% | −60 + 140 mesh | |
| 117 | 85% Fe/15% Zn | 2% | 0.15% | −60 + 140 mesh | |
| 118 | 75% Fe/25% Zn | 2% | 0.15% | −60 + 140 mesh | |
| 119 | 85% Fe/15% Zn | 2% | 0.15% | −60 + 140 mesh | |
| 120 | 85% Fe/15% Zn | 2% | 0.15% | −60 + 140 mesh | |
| 121 | 85% Fe/15% Zn | 2% | 0.15% | −60 + 140 mesh | |
| 122 | 75% Fe/25% Zn | 2% | 0.15% | −60 + 140 mesh | |
| 123 | 85% Fe/15% Zn | 2% | 0.15% | −60 + 140 mesh | |
| 124 | 85% Fe/15% Zn | 2% | 0.15% | −60 + 140 mesh | |
| 125 | 85% Fe/15% Zn | 2% | 0.15% | −60 + 140 mesh | |
| 126 | 85% Fe/15% Zn | 2% | 0.15% | −60 + 140 mesh | |
| 127 | 85% Fe/15% Zn | 0.50% | 0.20% | −60 + 140 mesh | |
| 128 | 85% Fe/15% Zn | 1% | 0.20% | −60 + 140 mesh | |
| 129 | 85% Fe/15% Zn | 1.50% | 0.20% | −60 + 140 mesh | |
| 130 | 85% Fe/15% Zn | 0.75% | 0.20% | −60 + 140 mesh | |
| 131 | 85% Fe/15% Zn | 1% | 0.20% | −60 + 140 mesh | |
| 132 | 85% Fe/15% Zn | 1.25% | 0.20% | −60 + 140 mesh | |
| 133 | 85% Fe/15% Zn | 1% | 0.20% | −80 + 200 mesh | |
| 134 | 85% Fe/15% Zn | 1% | 0.20% | −80 + 200 mesh | |
| 135 | 80 Fe/20% Zn | 1.25% | 0.20% | −80 + 200 mesh | |
| 136 | 85% Fe/15% Zn | 1.25% | 0.20% | −60 + 140 mesh | |
| 137 | 80 Fe/20% Zn | 1.25% | 0.20% | −80 + 200 mesh | |
| 138 | 85% Fe/15% Zn | 1.25% | 0.20% | −80 + 200 mesh | |
| 139 | 85% Fe/15% Zn | 1.25% | 0.20% | −60 + 140 mesh | |
| 140 | 85% Fe/15% Zn | 1.50% | 0.20% | −60 + 140 mesh | |
| 141 | 85% Fe/15% Zn | 2% | 0.20% | −60 + 140 mesh | |
| 142 | 85% Fe/15% Zn | 1.50% | 0.20% | −60 + 140 mesh | |
| 143 | 85% Fe/15% Zn | 2% | 0.20% | −60 + 140 mesh | |
| 144 | 85% Fe/15% Zn | 1.50% | 0.20% | −60 + 140 mesh | |
| 145 | 85% Fe/15% Zn | 2% | 0.20% | −60 + 140 mesh | |
| 146 | 85% Fe/15% Zn | 1.50% | 0.20% | −60 + 140 mesh | |
| 147 | 85% Fe/15% Zn | 2% | 0.20% | −60 + 140 mesh | |
| 148 | 85% Fe/15% Zn | 1% | 0.15% | −60 + 140 mesh | |
| 149 | 95% Fe/5% Zn | 2% | 0.15% | −60 + 140 mesh | |
| 150 | 85% Fe/15% Zn | 1% $H_3BO_3$, 1% borax | 0.15% | −60 + 140 mesh | |
| 151 | 85% Fe/15% Zn | 2% | 0.15% | −60 + 140 mesh | |
| 152 | 84% Fe/13% Zn/1% Cu | 2% | 0.15% | −60 + 140 mesh | |
| 153 | 85% Fe/15% Zn | 2% | 0.30% | −60 + 140 mesh | |
| 154 | 90% Fe/8% Zn | 2% | 0.15% | −60 + 140 mesh | |
| 155 | 85% Fe/13% Zn | 1% $H_3BO_3$, 1% borax | 0.15% | −60 + 140 mesh | |

TABLE 1-continued

| No. Composition (wt %) | Borate (wt %) | Wax (wt %) | Zinc Powder Particle Size | Density (g/cc) |
|---|---|---|---|---|
| 156 85% Fe/13% Zn | 2% | 0.20% | −60 + 140 mesh | |
| 157 83% Fe/14% Zn/1% Al | 2% | 0.15% | −60 + 140 mesh | |
| 158 85% Fe/13% Zn | 2% | 0.20% | −60 + 140 mesh | |
| 159 85% Fe/13% Zn | 2% | 0.20% | −60 + 140 mesh | |
| 160 85% Fe/13% Zn | 2% | 0.20% | −60 + 140 mesh | |
| 161 85% Fe/13% Zn | 2% | 0.20% | −60 + 140 mesh | |
| 162 85% Fe/13% Zn | 2% | 0.15% | +60 mesh | |
| 163 85% Fe/13% Zn | 2% | 0.15% | +60 mesh | |
| 164 84% Fe/15% Zn | 1% | 0.15% | −60 + 140 mesh | |
| 165 83.5% Fe/15% Zn | 1.50% | 0.15% | −60 + 140 mesh | |
| 166 83.75% Fe/15% Zn | 1.25% | 0.15% | −60 + 140 mesh | |
| 167 84% Fe/15% Zn | 1% | 0.15% | −60 + 140 mesh | |
| 168 84% Fe/14% Zn | 2% | 0.15% | −60 + 140 mesh | |
| 169 84% Fe/14% Zn | 2% | 0.15% | −60 + 140 mesh | |
| 170 84% Fe/14% Zn | 2% | 0.20% | −60 + 140 mesh | |
| 171 84% Fe/15% Zn | 1% | 0.15% | −60 + 140 mesh | |
| 172 83.5% Fe/15% Zn | 1.50% | 0.15% | −60 + 140 mesh | |
| 173 84% Fe/14% Zn | 2% | 0.20% | −60 + 140 mesh | |
| 174 75% Fe/23% Zn | 2% | 0.15% | −60 + 140 mesh | |
| 175 83% Fe/15% Zn/2% $NaHCO_3$ | | 0.20% | −60 + 140 mesh | |
| 176 85% Fe/13% Zn | 2% | 0.20% | −60 + 140 mesh | |
| 177 83% Fe/15%Zn/1.5% $NaHCO_3$ | 0.50% | 0.20% | −60 + 140 mesh | |
| 178 83% Fe/15% Zn/1% $NaHCO_3$ | 1% | 0.20% | −60 + 140 mesh | |
| 179 84% Fe/14% Zn | 2% | 0.20% | −60 + 140 mesh | |
| 180 84% Fe/14% Zn | 2% | 0.20% | −60 + 140 mesh | |
| 181 84% Fe/14% Zn | 2% | 0.20% | −60 + 140 mesh | |
| 182 84% Fe/14% Zn | 1% | 0.20% | −60 + 140 mesh | |
| 183 84% Fe/14% Zn | 2% | 0.20% | −60 + 140 mesh | |
| 184 84% Fe/14% Zn | 2% | 0.20% | −60 + 140 mesh | |
| 185 84% Fe/14% Zn | 2% | 0.20% | −60 + 140 mesh | |
| 186 84% Fe/14% Zn | 2% | 0.20% | −60 + 140 mesh | |
| 187 84% Fe/14% Zn | 2% | 0.20% | −60 + 140 mesh | |
| 188 84% Fe/14.5% Zn 0.5% ZnCl | 1% | 0.20% | −60 + 140 mesh | |
| 189 84% Fe/14% Zn | 2% | 0.20% | −60 + 140 mesh | |
| 190 84% Fe/14% Zn | 2% | 0.20% | −60 + 140 mesh | |
| 191 84% Fe/14% Zn | 2% | 0.20% | −60 + 140 mesh | |
| 192 84% Fe/14% Zn | 2% | 0.20% | −60 + 140 mesh | |
| 193 84% Fe/14% Zn | 2% | 0.20% | −60 + 140 mesh | |
| 194 84% Fe/14% Zn | 2% | 0.20% | −60 + 140 mesh | |
| 195 85% Fe/15% Zn | | 0.20% | −60 + 140 mesh | |
| 196 84% Fe/14% Zn | 2% | 0.20% | −60 + 140 mesh | |
| 197 84% Fe/14% Zn | 2% | 0.20% | −60 + 140 mesh | |
| 198 84% Fe/14% Zn | 2% | 0.20% | −60 + 140 mesh | |

TABLE II

| No. | Intermediate Hold Temp (° F.) | Intermediate Hold Time (min) | Heating Set Point Temp (° F.) | Heat Rate (° F./min) | Heat Treat Time (min) | Cooling | Diam. Increase after Heat Treat (in) |
|---|---|---|---|---|---|---|---|
| 1 | | | 760 | | 20 | | |
| 2 | | | 790 | | 20 | | |
| 3 | | | 820 | | 20 | | |
| 4 | | | 790 | | 20 | | |
| 5 | | | 790 | | 20 | | |
| 6 | | | 450 | | 20 | | |
| 7 | | | 450 | | 20 | | |
| 8 | | | 520 | | 20 | | |
| 9 | | | 520 | | 20 | | |
| 10 | | | 790 | | 20 | | |
| 11 | | | 790 | | 20 | | |
| 12 | | | 760 | | 20 | | |
| 13 | | | 760 | | 20 | | |
| 14 | | | 760 | | 20 | | |
| 15 | | | 525 | | 20 | | |
| 16 | | | 760 | | 20 | | |
| 17 | | | 760 | | 20 | | |
| 18 | | | 760 | | 20 | | |
| 19 | | | 1000 | | 1 | | |
| 20 | | | 1000 | | 4 | | |
| 21 | | | N/A | | N/A | | |
| 22 | | | 760 | | 900 | | |
| 23 | | | 650 | 4 | 60 | | 0.005 |
| 24 | | | 670 | | 60 | | 0.005 |

TABLE II-continued

| No. | Intermediate Hold Temp (° F.) | Intermediate Hold Time (min) | Heating Set Point Temp (° F.) | Heat Rate (° F./min) | Heat Treat Time (min) | Cooling | Diam. Increase after Heat Treat (in) |
|---|---|---|---|---|---|---|---|
| 25 | | | 670 | | 60 | | 0.005 |
| 26 | | | 670 | | 60 | | 0.001 |
| 27 | | | 670 | | 60 | | 0.002 |
| 28 | | | 670 | | 60 | | 0.005 |
| 29 | | | 705 | | 60 | | 0.001 |
| 30 | | | 705 | | 60 | | 0.002 |
| 31 | | | 705 | | 60 | | 0.005 |
| 32 | | | 740 | | 60 | | 0.001 |
| 33 | | | 740 | | 60 | | 0.003 |
| 34 | | | 670 | | 60 | | 0.002 |
| 35 | | | 670 | | 60 | | 0.003 |
| 36 | | | 670 | | 60 | | 0.002 |
| 37 | | | 705 | | 60 | | 0.002 |
| 38 | | | 705 | | 60 | | 0.005 |
| 39 | | | 705 | | 60 | | 0.005 |
| 40 | | | 740 | | 60 | | 0.003 |
| 41 | | | 740 | | 60 | | 0.005 |
| 42 | | | 740 | | 60 | | 0.010 |
| 43 | | | 670 | | 60 | | 0.001 |
| 44 | | | 670 | | 60 | | 0.002 |
| 45 | | | 670 | | 60 | | 0.001 |
| 46 | | | 705 | | 60 | | 0.001 |
| 47 | | | 705 | | 60 | | 0.004 |
| 48 | | | 705 | | 60 | | 0.002 |
| 49 | | | 740 | | 60 | | 0.002 |
| 50 | | | 740 | | 60 | | 0.005 |
| 51 | | | 740 | | 60 | | 0.004 |
| 52 | | | 670 | | 60 | | 0.002 |
| 53 | | | 740 | | 60 | | 0.002 |
| 54 | | | 670 | | 60 | Furnace Cooled | 0.002 |
| 55 | | | 735 | | 60 | Furnace Cooled | 0.002 |
| 56 | | | 670 | | 60 | Furnace Cooled | 0.002 |
| 57 | | | 670 | | 60 | Furnace Cooled | 0.003 |
| 58 | | | 670 | | 60 | Furnace Cooled | 0.002 |
| 59 | | | 645 | | 60 | Furnace Cooled | 0.0015 |
| 60 | | | 630 | | 60 | Furnace Cooled | 0.002 |
| 61 | | | 630 | | 60 | Furnace Cooled | 0.002 |
| 62 | | | 630 | | 30 | Furnace Cooled to 400° F. | .001-.0025 |
| 63 | | | 735 | | 60 | Furnace Cooled | 0.002 |
| 64 | | | 630 | | 60 | Furnace Cooled | 0.002 |
| 65 | | | 600 | | 60 | Furnace Cooled to 450° F. | 0.002 |
| 66 | | | 600 | | 60 | Furnace Cooled to 450° F. | 0.003 |
| 67 | | | 550 | | 60 | Furnace Cooled to 450° F. | 0.001 |
| 68 | | | 585 | | 60 | Furnace Cooled to 450° F. | 0.002 |
| 69 | | | 585 | | 60 | Furnace Cooled to 450° F. | 0.001 |
| 70 | | | 640 | | 45 | Furnace Cooled to 450° F. | 0.0025 |
| 71 | | | 610 | | 45 | Furnace Cooled to 450° F. | 0.002 |
| 72 | | | 610 | | 45 | Furnace Cooled to 450° F. | 0.003 |
| 73 | | | 630 | | 45 | Furnace Cooled to 450° F. | 0.004 |
| 74 | | | 630 | | 45 | Furnace Cooled to 450° F. | 0.002 |
| 75 | | | 600 | | 120 | Furnace Cooled to 450° F. | 0.004 |
| 76 | | | 580 | | 60 | Furnace Cooled to 450° F. | 0.001 |
| 77 | | | 674 | 3.5 | 45 | Furnace Cooled to 450° F. | 0.002 |
| 78 | | | 674 | 3.5 | 45 | Furnace Cooled to 450° F. | 0.005 |
| 79 | | | 674 | 3.5 | 45 | Furnace Cooled to 450° F. | 0.003 |
| 80 | | | 720 | 3.5 | 60 | Furnace Cooled to 450° F. | 0.002 |
| 81 | | | 720 | 3.5 | 60 | Furnace Cooled to 450° F. | 0.006 |
| 82 | | | 720 | 3.5 | 60 | Furnace Cooled to 450° F. | 0.004 |
| 83 | | | 750 | 3.5 | 60 | Furnace Cooled to 450° F. | 0.004 |
| 84 | | | 750 | 3.5 | 60 | Furnace Cooled to 450° F. | 0.007 |
| 85 | | | | | | Furnace Cooled to 450° F. | 0.004 |
| 86 | | | 720 | 3.5 | 60 | Furnace Cooled to 450° F. | 0.004 |
| 87 | | | 690 | 3.5 | 120 | Furnace Cooled to 450° F. | 0.002 |
| 88 | | | 690 | 3.5 | 120 | Furnace Cooled to 450° F. | 0.001 |
| 89 | | | 690 | 3.5 | 120 | Furnace Cooled to 450° F. | 0.002 |
| 90 | | | 690 | 3.5 | 120 | Furnace Cooled to 450° F. | 0.002 |
| 91 | | | 690 | 3.5 | 120 | Furnace Cooled to 450° F. | 0.003 |
| 92 | | | 690 | 3.5 | 120 | Furnace Cooled to 450° F. | 0.002 |
| 93 | | | 680 | 3.5 | 120 | Furnace Cooled to 450° F. | 0.0015 |
| 94 | | | 680 | 3.5 | 120 | Furnace Cooled to 450° F. | 0.002 |
| 95 | | | 680 | 3.5 | 120 | Furnace Cooled to 450° F. | 0.0000 |
| 96 | | | 640 | 3.5 | 120 | Furnace Cooled to 450° F. | 0.0015 |
| 97 | | | 640 | 3.5 | 120 | Furnace Cooled to 450° F. | 0.003 |
| 98 | | | 640 | 3.5 | 120 | Furnace Cooled to 450° F. | 0.001 |
| 99 | | | 660 | 3.5 | 90 | Furnace Cooled to 450° F. | 0.002 |
| 100 | | | 660 | 3.5 | 90 | Furnace Cooled to 450° F. | 0.003 |

TABLE II-continued

| No. | Intermediate Hold Temp (° F.) | Intermediate Hold Time (min) | Heating Set Point Temp (° F.) | Heat Rate (° F./min) | Heat Treat Time (min) | Cooling | Diam. Increase after Heat Treat (in) |
|---|---|---|---|---|---|---|---|
| 101 | | | 660 | 3.5 | 90 | Furnace Cooled to 450° F. | 0.0025 |
| 102 | | | 660 | 3.5 | 90 | Furnace Cooled to 450° F. | 0.002 |
| 103 | | | 660 | 3.5 | 90 | Furnace Cooled to 450° F. | 0.002 |
| 104 | | | 650 | 3.5 | 120 | Furnace Cooled to 450° F. | 0.002 |
| 105 | | | 650 | 3.5 | 120 | Furnace Cooled to 450° F. | 0.001 |
| 106 | | | 650 | 3.5 | 120 | Furnace Cooled to 450° F. | 0.001 |
| 107 | | | 740 | 3.5 | 90 | Furnace Cooled to 450° F. | 0.003 |
| 108 | | | 675 | 3.5 | 90 | Furnace Cooled to 450° F. | 0.001 |
| 109 | | | 675 | 3.5 | 90 | Furnace Cooled to 450° F. | 0.001 |
| 110 | | | 675 | 3.5 | 90 | Furnace Cooled to 450° F. | 0.003 |
| 111 | | | 675 | 3.5 | 90 | Furnace Cooled to 450° F. | 0.0025 |
| 112 | | | 700 | 3.5 | 90 | Furnace Cooled to 450° F. | 0.001 |
| 113 | | | 700 | 3.5 | 60 | Furnace Cooled to 450° F. | 0.001 |
| 114 | | | 700 | 3.5 | 60 | Furnace Cooled to 450° F. | 0.001 |
| 115 | | | 700 | 10 | 60 | Furnace Cooled to 450° F. | 0.001 |
| 116 | | | 700 | 10 | 60 | Furnace Cooled to 450° F. | 0.001 |
| 117 | | | 675 | 3.5 | 120 | Furnace Cooled to 450° F. | 0.001 |
| 118 | | | 675 | 3.5 | 120 | Furnace Cooled to 450° F. | 0.001 |
| 119 | | | 725 | 10 | 120 | Furnace Cooled to 450° F. | 0.002 |
| 120 | | | 725 | 10 | 120 | Furnace Cooled to 450° F. | 0.001 |
| 121 | | | 645 | 3.5 | 120 | Furnace Cooled to 450° F. | 0.001 |
| 122 | | | 645 | 3.5 | 120 | Furnace Cooled to 450° F. | 0.001 |
| 123 | | | 660 | 4 | 120 | Furnace Cooled to 450° F. | 0.001 |
| 124 | | | 660 | 4 | 120 | Removed from furnace at 600° F. | 0.001 |
| 125 | | | 660 | 4 | 120 | Removed from furnace at 600° F.; water quenched | 0.0005 |
| 126 | | | 660 | 4 | 120 | Furnace Cooled to 450° F. | 0.001 |
| 127 | | | 660 | 4 | 120 | Furnace Cooled to 450° F. | 0.002 |
| 128 | | | 660 | 4 | 120 | Furnace Cooled to 450° F. | 0.001 |
| 129 | | | 660 | 4 | 120 | Furnace Cooled to 450° F. | 0.001 |
| 130 | | | 660 | 4 | 120 | Furnace Cooled to 450° F. | 0.0015 |
| 131 | 350 | 30 | 635 | 4 | 120 | Furnace Cooled to 450° F. | 0.001 |
| 132 | 350 | 30 | 635 | 4 | 120 | Furnace Cooled to 450° F. | 0.001 |
| 133 | 350 | 30 | 635 | 4 | 120 | Furnace Cooled to 450° F. | 0.001 |
| 134 | | | 660 | 4 | 120 | Furnace Cooled to 450° F. | 0.002 |
| 135 | | | 660 | 4 | 120 | Furnace Cooled to 450° F. | 0.004 |
| 136 | 360 | 40 | 600 | 2 | 120 | Furnace Cooled to 450° F. | 0.001 |
| 137 | 360 | 40 | 600 | 2 | 120 | Furnace Cooled to 450° F. | 0.001 |
| 138 | 360 | 40 | 600 | 2 | 120 | Furnace Cooled to 450° F. | 0.001 |
| 139 | 360 | 40 | 600 | 2 | 120 | Furnace Cooled to 450° F. | 0.001 |
| 140 | 360 | 40 | 600 | 2 | 120 | Furnace Cooled to 450° F. | 0.001 |
| 141 | 360 | 40 | 600 | 2 | 120 | Furnace Cooled to 450° F. | 0.001 |
| 142 | 360 | 40 | 600 | 2 | 180 | Furnace Cooled to 450° F. | 0.001 |
| 143 | 360 | 40 | 600 | 2 | 180 | Furnace Cooled to 450° F. | 0.001 |
| 144 | 360 | 30 | 620 | 2 | 120 | Furnace Cooled to 450° F. | 0.001 |
| 145 | 360 | 30 | 620 | 2 | 120 | Furnace Cooled to 450° F. | 0.001 |
| 146 | 360 | 30 | 620 | 3 | 120 | Furnace Cooled to 100° F. | 0.001 |
| 147 | 360 | 30 | 620 | 3 | 120 | Furnace Cooled to 100° F. | 0.001 |
| 148 | | | 660 | 3.5 | 120 | Furnace Cooled to 450° F. | 0.001 |
| 149 | | | 660 | 3.5 | 120 | Furnace Cooled to 450° F. | 0.001 |
| 150 | | | 660 | 3.5 | 60 | Furnace Cooled to 450° F. | 0.001 |
| 151 | | | 660 | 3.5 | 60 | Furnace Cooled to 450° F. | 0.001 |
| 152 | | | 660 | 3.5 | 120 | Furnace Cooled to 450° F. | 0.001 |
| 153 | | | 660 | 3.5 | 120 | Furnace Cooled to 450° F. | 0.001 |
| 154 | | | 660 | 3.5 | 105 | Furnace Cooled to 450° F. | 0.001 |
| 155 | | | 660 | 3.5 | 105 | Furnace Cooled to 450° F. | 0.0005 |
| 156 | | | 660 | 3.5 | 105 | Furnace Cooled to 450° F. | 0.001 |
| 157 | | | 660 | 3.5 | 105 | Furnace Cooled to 450° F. | 0.001 |
| 158 | | | 740 | 3.5 | 30 | Furnace Cooled to 450° F. | 0.0005 |
| 159 | | | 780 | 3.5 | 30 | Furnace Cooled to 450° F. | 0.0005 |
| 160 | | | 825 | 3.5 | 30 | Furnace Cooled to 450° F. | 0.008 |
| 161 | | | 800 | 3.5 | 30 | Furnace Cooled to 450° F. | 0.001 |
| 162 | | | 800 | 3.5 | 30 | Furnace Cooled to 450° F. | 0.001 |
| 163 | | | 800 | 3.5 | 60 | Furnace Cooled to 450° F. | Cracked |
| 164 | | | 660 | 3.5 | 120 | Removed from furnace at 600° F. | 0.001 |
| 165 | | | 660 | 3.5 | 120 | Furnace Cooled to 450° F. | 0.001 |
| 166 | | | 660 | 3.5 | 120 | Furnace Cooled to 450° F. | 0.001 |
| 167 | | | 660 | 3.5 | 120 | Furnace Cooled to 450° F. | 0.001 |
| 168 | | | 660 | rapid | 30 | Rapid cooling | 0.001 |
| 169 | | | 660 | rapid | 60 | Rapid cooling | 0.001 |
| 170 | | | 660 | 3.5 | 120 | Furnace Cooled to 450° F. | |
| 171 | | | 660 | 4 | 120 | Furnace Cooled to 450° F. | 0.001 |
| 172 | | | 660 | 4 | 120 | Furnace Cooled to 450° F. | 0.001 |
| 173 | | | 660 | 4 | 90 | Furnace Cooled to 450° F. | 0.001 |
| 174 | | | 660 | 4 | 90 | Furnace Cooled to 450° F. | 0.001 |
| 175 | | | 660 | 4 | 105 | Furnace Cooled to 450° F. | 0.0015 |

TABLE II-continued

| No. | Intermediate Hold Temp (° F.) | Intermediate Hold Time (min) | Heating Set Point Temp (° F.) | Heat Rate (° F./min) | Heat Treat Time (min) | Cooling | Diam. Increase after Heat Treat (in) |
|---|---|---|---|---|---|---|---|
| 176 | | | 660 | 4 | 105 | Furnace Cooled to 450° F. | 0.001 |
| 177 | | | 660 | 4 | 105 | Furnace Cooled to 450° F. | 0.001 |
| 178 | | | 660 | 4 | 105 | Furnace Cooled to 450° F. | 0.001 |
| 179 | | | 566 | 4 | 105 | Furnace Cooled to 440° F. | 0.001 |
| 180 | | | 550 | 4 | 105 | Furnace Cooled to 440° F. | 0.001 |
| 181 | | | 525 | 4 | 105 | Furnace Cooled to 400° F. | 0.001 |
| 182 | | | 525 | 4 | 105 | Furnace Cooled to 400° F. | 0.001 |
| 183 | | | 500 | 4 | 105 | Furnace Cooled to 400° F. | 0.001 |
| 184 | | | 475 | 4 | 105 | Furnace Cooled to 400° F. | 0.001 |
| 185 | | | 525 | 4 | 105 | Furnace Cooled to 400° F. | 0.001 |
| 186 | | | 535 | 4 | 105 | Furnace Cooled to 400° F. | 0.001 |
| 187 | | | 530 | 4 | 105 | Furnace Cooled to 400° F. | 0.001 |
| 188 | | | 530 | 4 | 105 | Furnace Cooled to 400° F. | 0.0005 |
| 189 | | | 525 | 4 | 105 | Furnace Cooled to 400° F. | 0.001 |
| 190 | | | 565 | rapid | 90 | Furnace Cooled to 400° F. | 0.0005 |
| 191 | | | 525 | 4 | 105 | Furnace Cooled to 400° F. | 0.001 |
| 192 | | | 530 | 4 | 105 | Furnace Cooled to 450° F. | 0.0005 |
| 193 | | | 530 | 4 | 105 | Furnace Cooled to 450° F. | 0.0005 |
| 194 | | | 530 | 4 | 105 | Furnace Cooled to 450° F. | 0.001 |
| 195 | | | 630 | 4 | 60 | Furnace Cooled to 450° F. | 0.0015 |
| 196 | | | 530 | 4 | 105 | Furnace Cooled to 450° F. | 0.001 |
| 197 | | | 530 | 4 | 105 | Furnace Cooled to 450° F. | 0.001 |
| 198 | | | 530 | 4 | 105 | Furnace Cooled to 450° F. | 0.001 |

Overall, when considering these and/or other factors, a goal may be to produce a frangible firearm projectile that is sufficiently dense to meet projectile weight requirements in standard projectile sizes, strong enough to process, package, and ship using automated equipment, and frangible enough to break into sufficiently small particulate when shot against a metal or similar hard target.

While the compacted mixtures 110 and the material compositions thereof are discussed herein primarily in the context of frangible firearm projectiles containing primarily iron and zinc, it is within the scope of the present disclosure that the material compositions disclosed herein may be utilized to form other articles and/or projectiles. In addition, anti-sparking agents 118 may be utilized in other powder metallurgy compositions for forming firearm projectiles, including compacted mixtures that include a single metal powder or any appropriate combination of metal powders other than those specifically recited herein.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Examples of firearm projectiles, methods for forming the same, and firearm cartridges containing the same are presented in the following enumerated paragraphs.

A1. A frangible firearm projectile, comprising:

a frangible projectile body comprising a compacted mixture of metal powders;

wherein the compacted mixture of metal powders includes iron powder and zinc powder; and wherein the frangible firearm projectile includes a plurality of discrete alloy domains of the iron powder and the zinc powder.

A2. A frangible firearm projectile, comprising:

a frangible projectile body comprising a compacted mixture of metal powders;

wherein the compacted mixture of metal powders includes iron powder and zinc powder; and wherein the frangible firearm projectile includes an anti-sparking agent configured to reduce a propensity for the frangible firearm projectile to produce sparks upon striking a target after being fired.

A3. The frangible firearm projectile of any paragraphs A1-A2, wherein the compacted mixture of metal powders forms at least 90 wt % of the frangible projectile body, and optionally at least 92 wt %, at least 94 wt %, at least 95 wt %, at least 96 wt %, at least 97 wt %, at least 98 wt %, at least 99 wt %, and/or all of the frangible projectile body.

A3.1. The frangible firearm projectile of paragraphs A1-A3, wherein the compacted mixture of metal powders includes iron powder as a majority component by weight.

A3.2. The frangible firearm projectile of paragraphs A1-A3.1, wherein the compacted mixture of metal powders further includes at least 5 wt % zinc powder;

A3.3. The frangible firearm projectile of paragraphs A1-A3.2, wherein the compacted mixture of metal powders includes 80-90 wt % iron powder and 10-20 wt % zinc powder.

A3.4. The frangible firearm projectile of paragraphs A1-A3.3, wherein the compacted mixture of metal powders further includes powder of at least one of copper, tungsten, bismuth, nickel, tin, boron, and alloys thereof.

A3.5. The frangible firearm projectile of paragraphs A1-A3.4, wherein the compacted mixture of metal powders collectively forms at least one of at least 95%, at least 96%, at least 97%, at least 98%, at least 98.5%, at least 99%, at least 99.5%, and 100% of the frangible projectile body, by weight.

A3.6. The frangible firearm projectile of paragraphs A1-A3.5, wherein the compacted mixture includes a mixture of powders of at least one of at least 2 metals, 2 metals, 3 metals, 4 metals, and more than 4 metals.

A3.7. The frangible firearm projectile of paragraphs A1-A3.6, wherein the compacted mixture includes only non-toxic materials.

A3.8. The frangible firearm projectile of paragraphs A1-A3.7, wherein the compacted mixture does not include lead.

A3.9. The frangible firearm projectile of paragraphs A1-A3.8, wherein the compacted mixture includes a metal powder that forms a majority component of the compacted mixture, and wherein the compacted mixture further includes at least one metal powder that forms a secondary component that is present to a lesser extent than the majority component.

A3.10. The frangible firearm projectile of paragraphs A1-A3.9, wherein the compacted mixture includes at least one of zinc, copper, tungsten, bismuth, nickel, tin, boron, and alloys thereof at respective weight percentages of at least one of 0-40%, 0-30%, 0-20%, 0-15%, 0-10%, 0-5%, 5-40%, 5-35%, 5-30%, 5-25%, 5-20%, 5-15%, 5-10%, 10-30%, 10-25%, 10-20%, 10-15%, 0%, at least 5%, and/or at least 10%.

A3.11. The frangible firearm projectile of paragraphs A1-A3.10, wherein the compacted mixture includes iron powder at a weight percentage of at least one of at least 40%, 40-90%, 51-90%, 60-90%, 70-90%, 50-80%, 60-80%, 70-85%, at least 50%, at least 60%, at least 70%, at least 80%, at least 90%, at least 95%, at most 95%, at most 90%, and at most 85%.

A3.12. The frangible firearm projectile of paragraphs A1-A3.11, wherein the majority component of the compacted mixture of metal powders is iron powder.

A3.13. The frangible firearm projectile of paragraphs A1-A3.10, wherein the majority component of the compacted mixture of metal powders is tungsten powder.

A3.14. The frangible firearm projectile of paragraphs A1-A3.10, wherein the majority component of the compacted mixture of metal powders is copper powder.

A3.15. The frangible firearm projectile of paragraphs A1-A3.14, wherein each metal powder of a plurality of unique compositions of metal powders has a mesh size that is at least one of:

(i) at least 20 mesh, at least 40 mesh, at least 60 mesh, at least 80 mesh, at least 100 mesh, and at least 120 mesh; and (ii) at most 80 mesh, at most 100 mesh, at most 120 mesh, at most 140 mesh, at most 160 mesh, at most 180 mesh, and at most 200 mesh.

A4. The frangible firearm projectile of paragraphs A1-A3.15, wherein the metal powders in the compacted mixture of metal powders are bound together in the frangible projectile body by chemical bonds that include chemical bonds resulting from oxidation bonding of at least one of the iron powder and the zinc powder, A4.1. The frangible firearm projectile of any of paragraphs A4, wherein the chemical bonds include chemical bonds resulting from vapor-phase diffusion bonding of the zinc powder into the iron powder.

A4.2. The frangible firearm projectile of paragraph A4-A4.1, wherein the vapor-phase diffusion bonding includes vapor-phase galvanization of the iron powder.

A4.3. The frangible firearm projectile of any of paragraphs A4-A4.2, wherein the frangible firearm projectile body is free from melted metal powder and does not include a polymeric binder.

A4.4. The frangible firearm projectile of any of paragraphs A4-A4.3, wherein the chemical bonds do not result from liquid-phase sintering of the zinc powder and the iron powder.

A4.5. The frangible firearm projectile of any of paragraphs A4-A4.4, wherein the compacted mixture is strengthened via a process that includes at least one of diffusion bonding, solid-phase diffusion bonding, gas-phase diffusion bonding, vapor galvanization, sintering, solid-phase sintering, and covalent metal oxide bonding.

A5. The frangible firearm projectile of paragraphs A1-A4.5, wherein the frangible firearm projectile has a weight and is configured to break entirely into small particulate when fired from a firearm at a metal surface at close range, and optionally a range of 15 feet (4.57 meters).

A5.1. The frangible firearm projectile of paragraph A5, wherein the small particulate has a maximum particle weight of 5% of the weight of the frangible firearm projectile.

A5.2. The frangible firearm projectile of any of paragraphs A5-A5.1, wherein the frangible firearm projectile is configured to break into small particulate when fired at a metal surface at close range from a firearm cartridge.

A5.3. The frangible firearm projectile of any of paragraphs A5-A5.2, wherein the small particulate has a maximum particle weight that is at least one of at most 25 grains, at most 20 grains, at most 15 grains, at most 10 grains, at most 7.5 grains, at most 5 grains, in the range of 1-10 grains, in the range of 3-15 grains, in the range of 2-10 grains, and/or in the range of 0.5-5 grains.

A6. The frangible firearm projectile of paragraphs A1 or A3-A5.3, wherein the frangible firearm projectile includes an anti-sparking agent configured to reduce a propensity for the frangible firearm projectile to produce sparks upon striking a target after being fired.

A6.1. The frangible firearm projectile of paragraph A2 or A6, wherein the anti-sparking agent includes at least one of boric acid, borax, a borate, zinc chloride, petrolatum, sodium bicarbonate, polybenzimidazole fiber, melamine, modacrylic fiber, and hydroquinonone.

A6.2. The frangible firearm projectile of any of paragraphs A2 or A6-A6.1, wherein the anti-sparking agent forms at least a portion of a coating on an exterior of the frangible projectile body.

A6.3. The frangible firearm projectile of any of paragraphs A2 or A6-A6.2, wherein the anti-sparking agent is interspersed within an interior of the frangible projectile body.

A6.4. The frangible firearm projectile of any of paragraphs A2 or A6-A6.3, wherein the compacted mixture includes the anti-sparking agent at a weight percentage of at least one of at least 0.1%, at least 0.5%, at least 0.75%, at least 1%, at least 1.25%, at least 1.5%, at least 1.75%, at least 2%, at most 3%, at most 2%, at most 1.75%, at most 1.5%, at most 1.25%, at most 1%, at most 0.75%, at most 0.5%, 0.1-0.5%, 0.3-1%, 0.5-2%, 1-2%, and 1.5-2%.

A7. The frangible firearm projectile of any of paragraphs A1-A6.4, wherein the frangible firearm projectile has a density of at least 6.5 grams per cubic centimeter (g/cc), and optionally at least 6.6 g/cc, at least 6.7 g/cc, at least 6.8 g/cc, at least 6.9 g/cc, at least 7.0 g/cc, at least 7.1 g/cc, at least 7.2 g/cc, at least 7.5 g/cc, at least 8.0 g/cc, at least 8.5 g/cc, at least 9.0 g/cc, at least 9.5 g/cc, at least 10.0 g/cc, at least 10.5 g/cc, at least 11.0 g/cc, at least 11.1 g/cc, at least 11.2 g/cc, and/or at least 11.3 g/cc.

A7.1. The frangible firearm projectile of any of paragraphs A1-A6.4, wherein the frangible firearm projectile has a density of at least one of at least 6 grams per cubic centimeter (g/cc), at least 6.5 g/cc, at least 7 g/cc, at least 7.5 g/cc, at least 8 g/cc, at least 8.5 g/cc, at least 9.0 g/cc, at least 9.5 g/cc, at most 10 g/cc, at most 9.5 g/cc, at most 9 g/cc, at most 8.5 g/cc, at most 8.0 g/cc, at most 7.5 g/cc, at most 7.0 g/cc, in the range of 6.0-8.0 g/cc, in the range of 7.0-10.0 g/cc, in the range of 6.5-9.5 g/cc, in the range of 7.0-8.5 g/cc, in the range of 7.5-9.5 g/cc, and in the range of 7.5-8.5 g/cc.

A7.2. The frangible firearm projectile of any of paragraphs A1-A7.1, wherein the frangible firearm projectile has a density that is at least one of within +/−0.1 g/cc, within +/−0.2 g/cc, within +/−0.3 g/cc, within +/−0.4 g/cc, and within +/−0.5 g/cc of the density of a conventional lead bullet.

A8. The frangible firearm projectile of any of paragraphs A1-A7.2, wherein the compacted mixture further includes a lubricant configured to facilitate at least one of the relative movement and the collective flow of the metal powders when forming the compacted mixture.

A8.1. The frangible firearm projectile of paragraph A8, wherein the compacted mixture includes the lubricant at a weight percentage of at least one of at most 3%, at most 2%, at most 1%, at most 0.5%, 0.1-0.5%, and 0.3-1%.

A8.2. The frangible firearm projectile of any of paragraphs A8-A8.1, wherein the lubricant includes at least one of a wax, molybdenum disulfide, and graphite.

A8.3. The frangible firearm projectile of any of paragraphs A8-A8.2, wherein the compacted mixture includes the wax at a weight percentage of at least one of at most 3%, at most 2%, at most 1%, at most 0.5%, 0.1-0.5%, and 0.3-1%.

A8.4. The frangible firearm projectile of any of paragraphs A8-A8.3. wherein the lubricant includes a/the anti-sparking agent.

A8.5. The frangible firearm projectile of paragraph A8.4, wherein the lubricant includes the anti-sparking agent of any of paragraphs A6-A6.4.

A9. The frangible firearm projectile of any of paragraphs A1-A8.5, wherein the compacted mixture does not include a polymeric binder configured to bind a plurality of metal powders together.

A10. The frangible firearm projectile of any of paragraphs A1-A9, wherein the frangible firearm projectile is capable of withstanding a crushing force of at least one of at least 50 pounds, at least 60 pounds, at least 70 pounds, at least 80 pounds, at least 90 pounds, at least 100 pounds, at least 150 pounds, at least 200 pounds, at least 250 pounds, at least 300 pounds, at least 350 pounds, at least 400 pounds, at least 450 pounds, at least 500 pounds, at least 550 pounds, at least 600 pounds, at most 650 pounds, at most 625 pounds, at most 575 pounds, at most 525 pounds, at most 475 pounds, at most 425 pounds, at most 375 pounds, at most 325 pounds, at most 275 pounds, at most 225 pounds, at most 175 pounds, and/or at most 125 pounds, and/or in the range of 50-100 pounds, 60-80 pounds, 70-100 pounds, 100-250 pounds, 100-350 pounds, 200-350 pounds, 200-450 pounds, 300-450 pounds, 300-550 pounds, 400-550 pounds, 400-650 pounds, and 500-650 pounds without the frangible firearm projectile breaking into fragments.

A11. The frangible firearm projectile of any of paragraphs A1-A10, wherein the frangible firearm projectile is a bullet.

A11.1. The frangible firearm projectile of paragraph A11, wherein the bullet is a black powder bullet.

A12. The frangible firearm projectile of any of paragraphs A1-A10, wherein the frangible firearm projectile is a shot pellet.

A12.1. The frangible firearm projectile of paragraph A12, wherein the shot pellet at least one of is non-spherical, is ogived, has at least one faceted surface, has a tail, and has at least one dimple.

A12.2. The frangible firearm projectile of any of paragraphs A12-A12.1, wherein the frangible firearm projectile is a shot slug.

A13. The frangible firearm projectile of any of paragraphs A1-A12.2, wherein the frangible firearm projectile further includes a coating applied to an exterior of the frangible firearm projectile.

A13.1. The frangible firearm projectile of paragraph A13, wherein the coating includes at least one of an oxidation-resistant coating, a corrosion-inhibiting coating, a spall-inhibiting coating, a surface-sealing coating, and an abrasion-resistant coating.

A13.2. The frangible firearm projectile of any of paragraphs A13-A13.1, wherein the coating includes at least one of petrolatum, a borate, boric acid, and borax.

B1. A firearm cartridge, comprising:

a casing that defines an internal volume;

a propellant disposed in the internal volume;

a primer disposed in the internal volume and configured to ignite the propellant;

the frangible firearm projectile of any of paragraphs A1-A11 and A12-A13.2 at least partially received in the casing.

B2. The firearm cartridge of paragraph B 1, wherein at least one of:

the frangible firearm projectile is a bullet and the firearm cartridge is a bullet cartridge;

the frangible firearm projectile is a shot pellet, and the firearm cartridge is a shot shell;

the frangible firearm projectile is a shot pellet, and the firearm cartridge is a shot shell containing a plurality of the frangible firearm projectiles; and the frangible firearm projectile is a shot slug and the firearm cartridge is a shot slug shell.

C1. A method for forming a frangible firearm projectile, the method comprising:

preparing a mixture of metal powders; wherein the mixture of metal powders includes iron powder and zinc powder;

compacting the mixture of metal powders to form a compacted mixture;

heating the compacted mixture to a heating set point temperature;

maintaining the compacted mixture at a maintaining temperature for a maintaining time; and cooling the frangible firearm projectile.

C2. The method of paragraph C1, wherein the preparing the mixture of metal powders includes determining the metal powders to be included in the mixture; wherein the determining includes at least one of selecting a subset of a range of metal powders available, augmenting a distribution of particle sizes in the metal powder, obtaining the metal powder from a source, and/or determining a relative percentage of the mixture of metal powders to be formed from a particular metal powder.

C2.1. The method of any of paragraphs C1-C2, wherein the preparing includes at least one of pre-heating and drying the metal powders that form the mixture of metal powders.

C2.2. The method of any of paragraphs C1-C2.1, wherein the compacted mixture of metal powders includes the compacted mixture of metal powders of any of paragraphs A3-A3.15.

C2.3. The method of any of paragraphs C2-C2.2, wherein the method does not include adding a polymeric binder to the mixture of metal powders or melting any of the metal powders in the compacted mixture of metal powders.

C2.4. The method of any of paragraphs C2-C2.3, wherein the preparing the mixture of metal powders includes blending a plurality of selected metal powders to form the mixture of metal powders.

C2.5. The method of any of paragraphs C2-C2.4, wherein the preparing the mixture of metal powders further includes adding an anti-sparking agent to the mixture of metal powders.

C2.6. The method of paragraph C2.5, wherein the anti-sparking agent is or includes the anti-sparking agent of any of paragraphs A6-A6.1 and A6.3-A6.4.

C3. The method of any of paragraphs A1-C2.2, wherein the heating does not include melting any of the zinc powders and the iron powders in the mixture of metal powders.

C3.1. The method of any of paragraphs A1-C3, wherein the heating set point temperature is at least one of at least 100° C., at least 150° C., at least 200° C., at least 250° C., at least 260° C., at least 300° C., at least 350° C., at least 400° C., at least 450° C., at most 500° C., at most 475° C., at most 425° C., at most 375° C., at most 325° C., at most 275° C., at most 225° C., at most 175° C., at most 125° C., in the range of 100-300° C., in the range of 250-450° C., and in the range of 300-500° C.

C3.2. The method of paragraph C3.1, wherein the heating set point temperature is at least 260° C. (500° F.) and less than 404.4° C. (760° F.).

C3.3. The method of any of paragraphs C1-C3.2, wherein the heating set point temperature is lower than a lowest melting point of any of the metal powders present in the compacted mixture.

C3.4. The method of any of paragraphs C1-C3.3, wherein the heating set point temperature is at least one of at least 5° C., at least 10° C., at least 15° C., at least 20° C., at least 25° C., at most 30° C., at most 25° C., at most 20° C., and at most 15° C. below the lowest melting point of the metal powders present in the compacted mixture.

C3.5. The method of any of paragraphs C1-C3.4, wherein the heating set point temperature is one of substantially equal to, equal to, and greater than a lowest melting point of any of the metal powders present in the compacted mixture.

C3.6. The method of any of paragraphs C1-C3.5, wherein the heating set point time is sufficiently short that the heating does not melt any of the metal powders in the compacted mixture.

C3.7. The method of any of paragraphs C1-C3.6, wherein the heating set point time is at least one of at least 5 minutes, at least 10 minutes, at least 15 minutes, at least 20 minutes, at least 30 minutes, at least 45 minutes, at least 60 minutes, at least 120 minutes, at least 180 minutes, at least 240 minutes, at least 300 minutes, at most 360 minutes, at most 330 minutes, at most 270 minutes, at most 210 minutes, at most 150 minutes, at most 100 minutes, at most 75 minutes, at most 50 minutes, at most 40 minutes, at most 30 minutes, in the range of 10-30 minutes, and in the range of 20-60 minutes.

C3.8. The method of any of paragraphs C1-C3.7, wherein the heating includes a heating phase that includes increasing the temperature of the compacted mixture at a heating rate that is in the range of 1-5° C./minute.

C3.9. The method of any of paragraphs C1-C3.8, wherein the heating rate is at least one of at least 0.5° C./minute, at least 1° C./minute, at least 1.5° C./minute, at least 2° C./minute, at least 2.5° C./minute, at least 3.0° C./minute, at least 3.5° C./minute, at least 4.0° C./minute, at least 4.5° C./minute, at most 5° C./minute, at most 4.5° C./minute, at most 4° C./minute, at most 3.5° C./minute, at most 3° C./minute, in the range of 0.5-1.5° C./minute, in the range of 1-2° C./minute, in the range of 1.5-2.5° C./minute, in the range of 2-3° C./minute, in the range of 2-4° C./minute, in the range of 3-5° C./minute, and in the range of 4-5° C./minute.

C3.10. The method of any of paragraphs C1-C3.9, wherein the heating phase has a duration that is at least one of at least 5 minutes, at least 10 minutes, at least 15 minutes, at least 20 minutes, at least 30 minutes, at least 45 minutes, at least 60 minutes, at least 120 minutes, at least 180 minutes, at least 240 minutes, at least 300 minutes, at most 360 minutes, at most 330 minutes, at most 270 minutes, at most 210 minutes, at most 150 minutes, at most 100 minutes, at most 75 minutes, at most 50 minutes, at most 40 minutes, at most 30 minutes, in the range of 10-30 minutes, and in the range of 20-60 minutes.

C3.11. The method of any of paragraphs C1-C3.10, wherein the heating does not include melting any of the metal powders.

C3.12. The method of any of paragraphs C1-C3.11, wherein the heating includes, prior to the maintaining, a heating phase that includes increasing the temperature of at least one of:

(i) the compacted mixture; and (ii) a/the furnace in which the compacted mixture is heated;

and wherein the heating phase further includes increasing the temperature at a substantially constant, and optionally constant, heating rate until the temperature of the compacted mixture reaches the heating set point temperature.

C3.13. The method of any of paragraphs C1-C3.12, wherein the heating includes placing the compacted mixture in a furnace.

C3.14. The method of paragraph C3.13, wherein the heating phase includes preheating the furnace to the heating set point temperature and subsequently placing the compacted mixture into the furnace.

C3.15. The method of any of paragraphs C1-C3.14, wherein the heating includes heating in an environment that includes, and optionally is, at least one of air, an oxygen-rich atmosphere, a hydrogen-rich atmosphere, an inert atmosphere, a nitrogen-rich atmosphere, and a vacuum.

C4. The method of any of paragraphs C1-C3.15, wherein the maintaining time is at least 30 minutes.

C4.1. The method any of paragraphs C1-C4, wherein the maintaining temperature is within 10% of the heating set point temperature.

C4.2. The method of any of paragraph C1-C4.1, wherein the maintaining time is at least one of at least 5 minutes, at least 10 minutes, at least 15 minutes, at least 20 minutes, at least 30 minutes, at least 45 minutes, at least 60 minutes, at least 120 minutes, at least 180 minutes, at least 240 minutes, at least 300 minutes, at most 360 minutes, at most 330 minutes, at most 270 minutes, at most 210 minutes, at most 150 minutes, at most 100 minutes, at most 75 minutes, at most 50 minutes, at most 40 minutes, at most 30 minutes, in the range of 10-30 minutes, and in the range of 20-60 minutes.

C5. The method of any of paragraphs C1-C4.2, wherein the heating and the maintaining create a plurality of discrete alloy domains of the iron powder and the zinc powder within the compacted mixture.

C5.1. The method of any of paragraphs C1-05, wherein the heating and maintaining create chemical bonds formed by oxidation bonding of the iron powder and vapor-phase diffusion bonding of the zinc powder and the iron powder.

C6. The method of any of paragraphs C1-05.1, wherein the compacting includes compacting the mixture of metal powders to at least 30,000 pounds per square inch (psi), at least 40,000 psi, at least 50,000 psi (344.8 megapascal (MPA)), at least 60,000 psi, at least 70,000 psi, and/or at least 80,000 psi.

C6.1. The method of any of paragraphs C1-C6, wherein the compacting includes loading the mixture of metal powders into a die and subsequently applying a compaction pressure to the mixture of metal powders to form the compacted mixture.

C6.2. The method of any of paragraphs C1-C6.1, wherein the die defines a near-net shape, and optionally a final shape, of the frangible firearm projectile.

C7. The method of any of paragraphs C1-C6.2, wherein the cooling includes cooling the compacted mixture at a cooling rate in the range of 1-5° C./minute to a cooling set point temperature that is less than 250° C. and greater than 150° C.

C7.1. The method of any of paragraphs C1-C7, wherein the cooling includes at least one of a passive cooling step and active cooling step.

C7.2. The method of any of paragraphs C1-C7.1, wherein the cooling includes the passive cooling step in series with the active cooling step.

C7.3. The method of any of paragraphs C1-C7.2, wherein the cooling includes performing the active cooling step for an active cooling time interval and subsequently performing the passive cooling step.

C7.4. The method of any of paragraphs C1-C7.3, wherein the active cooling time interval is at least one of at least 10 minutes, at least 20 minutes, at least 30 minutes, at least 60 minutes, at least 90 minutes, at least 120 minutes, at least 150 minutes, at most 180 minutes, at most 165 minutes, at most 135 minutes, at most 105 minutes, at most 75 minutes, at most 45 minutes, and at most 15 minutes.

C7.5. The method of any of paragraphs C1-C7.4, wherein the cooling includes performing the active cooling step until the frangible firearm projectile reaches a threshold active cooling temperature and subsequently performing the passive cooling step.

C7.6. The method of any of paragraphs C1-C7.5, wherein the threshold active cooling temperature is at least one of at least 100° C., at least 150° C., at least 200° C., at least 250° C., at least 300° C., at least 350° C., at most 375° C., at most 325° C., at most 275° C., at most 225° C., at most 175° C., at most 125° C., and in the range of 100-300° C.

C7.7. The method of any of paragraphs C1-C7.6, wherein the active cooling step includes bringing the frangible firearm projectile to the threshold active cooling temperature in a/the furnace.

C7.8. The method of any of paragraphs C1-C7.7, wherein the active cooling step includes cooling the frangible firearm projectile at an active cooling rate, and wherein the active cooling rate is at least one of at least 0.5° C./minute, at least 1° C./minute, at least 1.5° C./minute, at least 2° C./minute, at least 2.5° C./minute, at least 3.0° C./minute, at least 3.5° C./minute, at least 4.0° C./minute, at least 4.5° C./minute, at most 5° C./minute, at most 4.5° C./minute, at most 4°

C./minute, at most 3.5° C./minute, at most 3° C./minute, in the range of 0.5-1.5° C./minute, in the range of 1-2° C./minute, in the range of 1.5-2.5° C./minute, in the range of 2-3° C./minute, in the range of 2-4° C./minute, in the range of 3-5° C./minute, and in the range of 4-5° C./minute.

C7.9. The method of any of paragraphs C1-C7.8, wherein the passive cooling step includes permitting the frangible firearm projectile to passively equilibrate to room temperature.

C7.10. The method of any of paragraphs C1-C7.9, wherein the active cooling step includes regulating a cooling rate of the frangible firearm projectile such that the cooling rate is slower than would be achieved by permitting the frangible firearm projectile to passively equilibrate to room temperature.

C7.11. The method of any of paragraphs C1-C7.10, wherein the active cooling step includes regulating a cooling rate of the frangible firearm projectile such that the cooling rate is faster than would be achieved by permitting the frangible firearm projectile to passively equilibrate to room temperature.

C7.12. The method of any of paragraphs C1-C7.11, wherein the active cooling step includes applying a fluid stream to the frangible firearm projectile with at least one of a fan and a blower.

C8. The method of any of paragraphs C1-C7.12, wherein the method further includes, subsequent to the cooling the frangible firearm projectile, applying an anti-sparking coating to an exterior of the frangible firearm projectile.

C8.1. The method of paragraph C8, wherein the anti-sparking coating includes at least one of petrolatum, boric acid, zinc chloride, and borax.

C9. The method of any of paragraphs C1-C8.1, wherein the method further includes, subsequent to the cooling the frangible firearm projectile, performing at least one finishing step on the frangible firearm projectile.

C9.1. The method of paragraph C9, wherein the at least one finishing step includes applying a coating to an exterior of the frangible firearm projectile.

C9.2. The method of paragraph C9.1, wherein the applying the coating includes at least one of spraying the frangible firearm projectile with the coating and dipping the frangible firearm projectile in the coating.

C9.3. The method of paragraph C9.2, wherein the dipping includes passing the frangible firearm projectile through a bath that includes the coating.

C9.4. The method of any of paragraphs C9.1-C9.2, wherein the dipping includes passing the frangible firearm projectile through the bath via a bucket elevator.

C9.5. The method of any of paragraphs C9.1-C9.4, wherein the applying the coating includes, prior to the passing the frangible firearm projectile through the bath, heating the bath to a bath temperature sufficient to liquefy the bath.

C9.6. The method of paragraph C9.5, wherein the bath temperature is at least one of at least 50° C., at least 65° C., at least 75° C., at least 85° C., at least 100° C., at least 125° C., at least 150° C., at least 175° C., at least 200° C., at most 225° C., at most 180° C., at most 160° C., at most 130° C., at most 90° C., at most 80° C., at most 70° C., and at most 60° C.

C9.7. The method of any of paragraphs C9.1-C9.6, wherein the applying the coating further includes homogenizing a thickness of the coating on the frangible firearm projectile.

C9.8. The method of any of paragraphs C9-C9.7, wherein the at least one finishing step includes adjusting a final shape of the frangible firearm projectile.

C9.9. The method of paragraph C9.8, wherein the adjusting includes tumbling the projectile with at least one of:

(i) a plurality of other frangible firearm projectiles; and (ii) a plurality of tumbling media.

C9.10. The method of any of paragraphs C9.8-C9.9, wherein the adjusting includes mechanically shaping at least a portion of the frangible firearm projectile.

C9.11. The method of paragraph C9.10, wherein the mechanically shaping includes grinding at least a portion of the frangible firearm projectile.

C10. A method of assembling a firearm cartridge, the method comprising:

forming at least one frangible firearm projectile by the method of any of paragraphs C1-C9.11, and loading the at least one frangible firearm projectile into a casing that includes a propellant and a primer configured to ignite the propellant.

C11. A method of assembling a firearm cartridge, the method comprising:

forming at least one frangible firearm projectile of any of paragraphs A1-A13.2 by the method of any of paragraphs C1-C10; and loading the at least one frangible firearm projectile into a casing that includes a propellant and a primer configured to ignite the propellant.

C12. A frangible firearm projectile formed by the method of any of paragraphs C1-C10.

D1. The use of the methods of any of paragraphs C1-C10 to form a frangible firearm projectile.

D2. The use of the methods of any of paragraphs C1-C10 to form the frangible firearm projectile of any of paragraphs A1-A13.2.

D3. A firearm cartridge containing a frangible firearm projectile formed by the use of any of paragraphs D1-D2.

INDUSTRIAL APPLICABILITY

The frangible firearm projectiles, firearm cartridges, and methods disclosed herein are applicable to the firearm industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A frangible firearm projectile, comprising:

a frangible projectile body consisting essentially of:

a compacted mixture of an anti-sparking agent and metal powders, wherein the metal powders form at least 90 wt % of the frangible projectile body, and wherein the anti-sparking agent is configured to reduce a propensity for the frangible firearm projectile to produce sparks upon striking a target after being fired;

and further wherein the anti-sparking agent includes at least one of boric acid and a borate.

2. The frangible firearm projectile of claim 1, wherein the anti-sparking agent is boric acid.

3. The frangible firearm projectile of claim 1, wherein the anti-sparking agent is interspersed within an interior of the frangible projectile body.

4. The frangible firearm projectile of claim 1, wherein the anti-sparking agent forms at least a portion of a coating on an exterior of the frangible projectile body.

5. The frangible firearm projectile of claim 1, wherein the anti-sparking agent further includes zinc chloride, petrolatum, sodium bicarbonate, polybenzimidazole fiber, melamine, modacrylic fiber, and hydroquinonone.

6. The frangible firearm projectile of claim 1, wherein the anti-sparking agent forms 0.5-5 wt % of the frangible firearm projectile.

7. The frangible firearm projectile of claim 1, wherein the compacted mixture of metal powders includes metal powder of at least one of zinc, iron, copper, tungsten, bismuth, nickel, tin, boron, and alloys thereof.

8. The frangible firearm projectile of claim 1, wherein the compacted mixture of metal powders includes iron powder and zinc powder.

9. The frangible firearm projectile of claim 8, wherein the iron powder forms a majority component of the compacted mixture, by weight.

10. The frangible firearm projectile of claim 8, wherein the compacted mixture includes at least 5 wt % zinc powder.

11. The frangible firearm projectile of claim 1, wherein the compacted mixture of metal powders includes copper powder.

12. The frangible firearm projectile of claim 11, wherein the compacted mixture of metal powders includes at least 60 wt % copper powder.

13. The frangible firearm projectile of claim 1, wherein the frangible firearm projectile has a density of at least 6.5 grams per cubic centimeter.

14. The frangible firearm projectile of claim 1, wherein the compacted mixture of metal powders includes 80-90 wt % iron powder and 10-20 wt % zinc powder, wherein the frangible firearm projectile has a density of at least 6.5 grams per cubic centimeter, wherein the frangible firearm projectile has a weight and is configured to break entirely into small particulate when fired at a metal surface at close range from a firearm cartridge, and wherein the small particulate has a maximum particle weight of 5% of the weight of the frangible firearm projectile.

15. A firearm cartridge, comprising: a casing that defines an internal volume;

a propellant disposed in the internal volume;

a primer disposed in the internal volume and configured to ignite the propellant; and the frangible firearm projectile of claim 1 at least partially received in the casing.

16. A method, for forming the frangible firearm projectile of claim 1, the method comprising:

preparing a mixture of metal powders and the anti-sparking agent; and forming the mixture of metal powders and the anti-sparking agent into the frangible projectile body of claim 1, wherein the forming comprises:

compacting the mixture of metal powders and the anti-sparking agent to form a compacted mixture;

heating the compacted mixture to a heating set point temperature; wherein the heating set point temperature is at least 260° C. (500° F.) and less than 404.4° C. (760° F.);

maintaining the compacted mixture at a maintaining temperature for maintaining time; wherein the maintaining time is at least 20 minutes, wherein the maintaining temperature is within 10% of the heating set point temperature; wherein the heating and the maintaining create a plurality of discrete alloy domains of the iron powder and the zinc powder within the compacted mixture; and cooling the frangible firearm projectile compacted mixture.

17. The method of claim 16, wherein the cooling includes cooling the compacted mixture at a cooling rate in the range of 1-5° C./minute to a cooling set point temperature that is less than 250° C. and greater than 150° C.

18. The method of claim 16, wherein the compacting includes compacting the mixture of metal powders to at least 50,000 pounds per square inch (psi) (344.8 megapascal (MPA)).

19. A method of assembling a firearm cartridge, the method comprising:

forming at least one frangible firearm projectile by the method of claim 16, and loading the at least one frangible firearm projectile into a casing that includes a propellant and a primer configured to ignite the propellant.

20. A firearm cartridge formed by the method of claim 19, wherein the frangible firearm projectile has a density of at least 6.5 g/cc and a weight, and wherein the frangible firearm projectile is configured to break entirely into small particulate having a maximum particle weight of 5% of the weight of the frangible firearm projectile when fired at a metal surface at close range from a firearm cartridge.

21. A frangible firearm projectile, comprising:

a frangible projectile body consisting essentially of a compacted mixture of metal powders that forms at least 90 wt % of the frangible projectile body; and wherein the frangible firearm projectile includes an anti-sparking agent dispersed within the compacted mixture, the anti-sparking agent configured to reduce a propensity for the frangible firearm projectile to produce sparks upon striking a target after being fired; and further wherein the anti-sparking agent includes at least one of boric acid, borax, and a borate, and further wherein the compacted mixture does not result from liquid-phase sintering.

* * * * *